US007656360B2

(12) United States Patent
Hirabayashi

(10) Patent No.: US 7,656,360 B2
(45) Date of Patent: Feb. 2, 2010

(54) ANTENNA DEVICE, WIRELESS COMMUNICATION APPARATUS USING THE SAME, AND CONTROL METHOD OF CONTROLLING WIRELESS COMMUNICATION APPARATUS

(75) Inventor: Takayuki Hirabayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 671 days.

(21) Appl. No.: 11/471,542

(22) Filed: Jun. 21, 2006

(65) Prior Publication Data

US 2007/0001924 A1 Jan. 4, 2007

(30) Foreign Application Priority Data

Jun. 30, 2005 (JP) ..... 2005-192730

(51) Int. Cl.
*H01Q 19/10* (2006.01)

(52) U.S. Cl. ..... 343/818; 343/893; 343/853

(58) Field of Classification Search ..... 343/810, 343/812, 814, 815, 816, 817, 818, 819, 820, 343/893, 853
See application file for complete search history.

(56) References Cited

U.S. PATENT DOCUMENTS 6,987,493 B2 * 1/2006 Chen ..... 343/893
7,242,366 B2 * 7/2007 Shibata ..... 343/893
7,268,738 B2 * 9/2007 Gothard et al. ..... 343/818
2004/0256644 A1 12/2004 Kugler et al.
2005/0156797 A1 * 7/2005 Chiang et al. ..... 343/702
2005/0212714 A1 * 9/2005 Chiang et al. ..... 343/810

FOREIGN PATENT DOCUMENTS

JP 2001-24431 1/2001
JP 2004-128557 4/2004
JP 2005-510886 4/2005

OTHER PUBLICATIONS

Kohei Mori, "Small Beam-Switched Antenna with RF Switch for Wireless LAN", 34th European Microwave Conference-Amsterdam, 2004, pp. 837-840.

* cited by examiner

*Primary Examiner*—HoangAnh T Le
(74) *Attorney, Agent, or Firm*—Oblon, Spivak, McClelland, Maier & Neustadt, L.L.P.

(57) ABSTRACT

An antenna device has semi-conductive antenna bodies each having a predetermined length, which are positioned on a dielectric substrate, and control electrodes that are respectively connected with the semi-conductive antenna bodies. Direct-current biased voltage applied across each of the control electrodes is controlled to switch each of the antenna bodies between their insulation state and their conductive state.

26 Claims, 18 Drawing Sheets

START

A1
SET COMBINATION I OF SWITCHES SW1 TROUGH SW6 TO I = 1
A2
PERFORM CARRIER SENSE
A4
WAIT FOR COLLISION AVOIDANCE
A3
SHOULD IT PERFORM COMMUNICATION ?
NO
YES
A5
MEASURE TRANSMISSION RATE
A7
STORE SETTING ON COMBINATION OF SWITCHES
A6
YES
IS IT MAXIMUM RATE ?
NO
A8
INCREMENT COMBINATION NUMBER I = I + 1
A9
I = N ?
NO
A10
YES
FIX THE SETTING
END

ANTENNA DEVICE, WIRELESS COMMUNICATION APPARATUS USING THE SAME, AND CONTROL METHOD OF CONTROLLING WIRELESS COMMUNICATION APPARATUS

CROSS REFERENCE TO RELATED APPLICATION

The present invention contains subject matters related to Japanese Patent Application No. JP 2005-192730 filed in the Japanese Patent Office on Jun. 30, 2005, the entire contents of which being incorporated herein by reference.

BACKGROUND OF THE INVENTION

1. Field of the Invention

The present invention relates to an antenna device, a wireless communication apparatus using the antenna device, a control method of controlling the wireless communication apparatus, a program product therefor, and a computer-readable storage medium therefor.

2. Description of Related Art

Recently, a wireless communication function has been often implemented in an information processing apparatus such as a personal computer, a communication terminal such as a mobile phone and a personal digital assistance (PDA), and any various kinds of consumer appliances such as an audio instrument, video equipment, a camera, a printer, and an entertainment robot. Further, such the wireless communication function has been often implemented in not only the electronics but also an access point for a wireless local area network (LAN) and a so-called accessory card of small size such as a card specified by personal computer memory card international association (PCMCIA), a compact flash card (trademark), and a mini peripheral component interconnection (PCI) card. The accessory card has been adapted to any wireless card module having such the wireless communication function and a storage function.

Under an actual application environment of these wireless communication functions, radio waves comes from various directions because there are any reflections by a building and an object or the like.

English Publication, "Small Beam-Switched Antenna with RF Switch for Wireless LAN", by K. Mori. 34th European Microwave Conference, p. 837, on October 2004, discloses a Yagi antenna device of slot type, which can improve its communication performance by using a sector antenna (a directional antenna) This Yagi antenna device of slot type performs a communication test according to a WLAN communication system to increase gain of reception and/or transmission signals in the radio waves. Such the communication test allows a throughput to be relatively increased by compared with a related omnidirectional antenna.

Japanese Publication, "New Antenna Engineering" by Hiroyuki ARAI, Sougou Electronics Publisher, in 1996, discloses a Yagi antenna device as a typical directional antenna. FIG. 1 illustrates a configuration of a Yagi antenna device 10 of monopole type according to a related art. This Yagi antenna device 10 has a base disk 7 that is a grounding base, and a printed board 9 having antenna elements. The base disk 7 and the printed board 9 are combined with each other. The base disk 7 has an opening 6 through which a wire for power supply passes on a predetermined position thereof. The printed board 9 is positioned on the base disk 7 so that they are intersected with each other at right angles. The antenna elements are patterned on the printed board 9 with a parasitic antenna element 1 for waveguide, which has a length L1, an excited antenna element 2, which has a length L2, and a parasitic antenna element 3 for reflector, which has a length L3, being arranged in order (L3>L2>L1).

If radio wave having a wavelength of λ is radiated from the Yagi antenna device 10, the length L2 of the excited antenna element (monopole element) 2 is a quarter wavelength long. The parasitic antenna element 1 is away from the excited antenna element 2 by an optional distance D1. Similarly, the parasitic antenna element 3 is away from the excited antenna element 2 by an optional distance. The excited antenna element 2 is connected to a signal source 8 via a wired line extending from the excitation antenna element 2 to an end of the signal source 8 though the opening 6. The signal source 8 transmits a signal to the excited antenna element 2 through the wired line. The other end of the signal source 8 is grounded.

Thus, the Yagi antenna device radiates radio wave toward a direction like an arrow (directed from left side to right side of FIG. 1).

Japanese Publication, "Transactions of Institute of Electronics, Information and Communication Engineers" by MARUYAMA, UEHARA and KAGOSHIMA, Vol. J80-B No. 5, in 1997 discloses a multi directional Yagi antenna device. This multi directional Yagi antenna device has some Yagi antenna devices each similar to the Yagi antenna device shown in FIG. 1, which are directed toward some directions on a circumference of the base disk, so that the multi directional Yagi antenna device can get multiple directivities.

A phased array antenna and an adaptive array antenna are derived from the sector antenna. These array antennas reinforce the effective radiation pattern of the array antenna in a desired direction and suppress it in undesired directions, which is so-called as "beamforming". These antennas can vary its directivity according to any receiving conditions of radio waves. Varying the directivity enables any communication performance to be increased. The communication performance is increased based on not only large gain of radio wave but also prevention of undesired radio wave from being received and transmitted.

Japanese Patent Application Publication No. 2001-24431 discloses the array antenna device relative to such the beamforming technology. This array antenna device constitutes electronically steerable parasitic array radiator (ESPAR). FIG. 2 illustrates an antenna device 80 with the beamforming functions. The antenna device 80 has a base disk 75, an excited antenna element 82, and parasitic antenna elements 81, 83, which are respectively arranged on both sides of the excited antenna element 82 at a suitable distance D2 from the excited antenna element 82. Items of variable reactance 84, 85 are respectively connected to the parasitic antenna elements 81, 83. If items of variable reactance 84, 85 are inductive, they act as extension coils, so that electrical length of each of the parasitic antenna elements 81, 83 can be extended to act as the reflectors. If items of variable reactance 84, 85 are capacitive, they act as shortened capacitor, so that electrical length of each of the parasitic antenna elements 81, 83 can be shortened to act as the waveguides. Thus, the antenna device 80 can radiate radio wave toward a desired direction by controlling the variable reactance 84, 85 of the parasitic antenna elements 81, 83.

In the above Yagi antenna device 10, if taking into consideration any performance on one-to-one communication by the wireless communication apparatuses, it is possible to improve any performance of throughput by using the directional antenna disclosed in the above English Publication, "Small Beam-Switched Antenna with RF Switch for Wireless LAN".

In a wireless local area network (wireless LAN), user's wireless communication apparatus generally communicates with plural access points ordinarily under the circumstances of home, office or the like. The user's wireless communication apparatus and the plural access points constitute a network. On the network, frequency bands and channels, which can be used by the plural wireless communication apparatuses, are fixed and finite according to their capacities. If any control is performed on them, any collisions and/or interferences of the radio waves occur between the plural wireless communication apparatuses, thereby causing only the incomplete communication to be implemented.

In a standard 802.11 on the wireless LAN, an access control function is installed in order to avoid the collisions and/or interferences of the radio waves. This standard is called as "carrier sense multiple access with collision avoidance (CSMA/CA)". According to the standard CSMA/CA, when a user wants to communicate with any destination, it is first sensed whether any other than the wireless communication apparatus that communicates does not communicate. The wireless communication apparatus can communicate only if it does not interfere with this other wireless communication apparatus (see Japanese Publication, "Realization of high-speed communication and its stabilization, the newest antenna technology, MIMO, WIRELSS PLUS", by Eiji TAKAGI, Web Magazine, in 2004).

SUMMARY OF THE INVENTION

Under the wireless LAN environment in which plural wireless communication apparatuses are present, however, it may be difficult to communicate with any destination after having sensed a carrier when using a directional antenna. In this case, the directional antenna reinforces the reception of radio wave from a desired direction and suppresses the reception of radio wave from another direction. Thus, irrespective of a case where any other than the wireless communication apparatus that wants to communicate any destination communicates, this wireless communication apparatus can transmit a radio wave with it failing to sense a carrier, so that it may interfere with the other wireless communication apparatus that communicates.

In the wireless LAN, it is desirable to use an omnidirectional antenna that can receive radio waves from every direction theoretically, not using a directional antenna. It is conceivable that, in the wireless LAN, an omnidirectional antenna can be used when sensing a carrier as well as a directional antenna can be used when carrying out any communication.

In order to cope well with this, two antennas of directional one and omnidirectional one are installed in the wireless communication apparatus and it is necessary to switch them or to arrange many parasitic antenna elements on a circumference of a base disk and to adjust load elements to radiate radio waves toward every direction. This causes an antenna device and a wireless communication apparatus to be made large-scaled and/or to be made expensive.

Thus, there is a need for providing an antenna device, a wireless communication apparatus, a control method of controlling the wireless communication apparatus, a computer program product therefor, and a computer-readable storage medium therefor that are possible to adjust directivity, radiated polarization and radiation direction of an antenna to desired ones without making an antenna device and a wireless communication apparatus large-scaled and/or expensive.

According to an embodiment of the invention, there is provided an antenna device. The antenna device has semi-conductive antenna bodies each having a predetermined length, which are positioned on a dielectric substrate, and control electrodes that are respectively connected with the antenna bodies. Direct-current biased voltage that is applied across each of the control electrodes is controlled to switch each of the antenna bodies between their insulation state and their conductive state.

In this embodiment of the antenna device, the semi-conductive antenna bodies each having a predetermined length are positioned on the dielectric substrate. The control electrodes are respectively connected with the antenna bodies across each of which the direct-current biased voltage is applied. This direct-current biased voltage is controlled to switch each of the antenna bodies between their insulation state and their conductive state.

For example, the antenna device has two line antenna bodies having different lengths, which are positioned on both sides of a dielectric substrate, and a conductive antenna body that is arranged on a middle of the dielectric substrate with it being away from each of the line antenna bodies by a predetermined distance. The conductive antenna body is fed. Forward biased voltage is applied across each of the control electrodes connected with the semi-conductive line antenna bodies or reverse biased voltage is applied across each of the control electrodes connected with the semi-conductive line antenna bodies. In this moment, forward biased voltage is applied across each of the control electrodes so that the ion can be moved from the dielectric substrate to the line antenna bodies, thereby making the line antenna bodies conductive. Reverse biased voltage is applied across each of the control electrodes so that the ion can be moved from each of the line antenna bodies to the dielectric substrate, thereby making the line antenna bodies insulated.

Thus, plural antenna bodies that have been made conductive are combined to configure a directional antenna device including a waveguide, a reflector, and the like. When the conductive antenna body remains as a feeder and the waveguide and the reflector are made insulated in the directional antenna, this enables omnidirectional antenna device to be implemented.

Thus, it is possible to adjust directivity/omnidirectivity, radiated polarization and radiation direction of the antenna device to desired ones without making the antenna device large-scaled and/or expensive.

According to another embodiment of the invention, there is provided a wireless communication apparatus. The wireless communication apparatus has an antenna device, a reception-and-transmission circuit that transmits and receives a signal according to a predetermined communication system, which are connected to the antenna device, and a communication control unit that controls the antenna device based on a signal received from the reception-and-transmission circuit. The antenna device includes semi-conductive antenna bodies each having a predetermined length, which are positioned on a dielectric substrate, and control electrodes that are respectively connected with the semi-conductive antenna bodies. The communication control unit controls the direct-current biased voltage applied across each of the control electrodes to switch each of the semi-conductive antenna bodies between their insulation state and their conductive state.

To this embodiment of the wireless communication apparatus according to the invention, the embodiment of the above antenna device according to the invention is applied. Further, the communication control unit that controls the antenna device is also provided. Controlling the direct-current biased voltage applied across each of the control electrodes connected with the semi-conductive antenna bodies that are positioned on the dielectric substrate allows each of the semi-conductive antenna bodies to be switched between their insulation state and their conductive state.

This enables a directional antenna including a waveguide and a reflector to be configured by combining plural semi-conductive antenna bodies that have been switched to their conductive states. When the conductive antenna body remains as a feeder and the waveguide and the reflector are made insulated in the directional antenna, this enables omni-directional antenna device to be implemented.

For example, setting the direct-current biased voltage applied across the control electrode connected with a predetermined semi-conductive antenna body in the antenna device according to carrier sense multiple access with collision avoidance (CSMA/CA) due to IEEE802.11a wireless LAN standard allows a carrier sense to be performed by using the omnidirectional antenna formed of the semi-conductive antenna bodies that have been switched to their conductive state or their insulated state.

Further, setting the direct-current biased voltage applied across each of the control electrodes connected with the semi-conductive antenna bodies in the antenna device allows a directional antenna to be formed by combining a waveguide and a reflector which are formed of the semi-conductive antenna bodies that have been switched to their conductive state or their insulated state. This enables any feedback setting on the direct-current biased voltage applied across the control electrodes to be implemented by guiding any wireless communication condition to a wireless communication apparatus of a destined node.

Thus, in the embodiment of the wireless communication apparatus according to the invention, it is possible to adjust directivity/omnidirectivity, radiated polarization, and radiation direction of the antenna device to desired ones without making the wireless communication apparatus large-scaled and/or expensive, thereby enabling to be implemented any wireless communication according to CSMA/CA.

According to further embodiment of the invention, there is provided a control method of controlling a wireless communication apparatus that has an antenna device. The antenna device includes semi-conductive antenna bodies each having a predetermined length, said antenna bodies being positioned on a dielectric substrate, and control electrodes that are respectively connected with the semi-conductive antenna bodies. Direct-current biased voltage applied across each of the control electrodes is controlled to switch each of the semi-conductive antenna bodies between their insulation state and their conductive state. The control method has the steps of setting the direct-current biased voltage to be applied across each of the control electrodes; and performing a carrier sense by using an omnidirectional antenna that has been formed by the set direct-current biased voltage that is applied across each of the control electrodes. The control method also has the steps of setting feedback on the direct-current biased voltage that is applied across each of the control electrodes by guiding the carrier sense and a wireless communication condition to a wireless communication apparatus of a destined node; and adaptively switching directivity, radiated polarization, and radiation direction of the antenna formed by the feedback direct-current biased voltage that is applied across each of the control electrodes.

To this embodiment of the control method of controlling the wireless communication apparatus according to the invention, the embodiment of the above antenna device according to the invention is applied. Further, the communication control unit that controls the antenna device is also provided. Controlling the direct-current biased voltage applied across each of the control electrodes connected with the semi-conductive antenna bodies that are positioned on the dielectric substrate allows each of the semi-conductive antenna bodies to be switched between their insulation state and their conductive state.

This enables a directional antenna including a waveguide and a reflector to be configured by combining plural semi-conductive antenna bodies that have been switched to their conductive states. When the conductive antenna body remains as a feeder and the waveguide and the reflector are made insulated in the directional antenna, this enables omni-directional antenna device to be implemented.

For example, in any wireless communication system according to CSMA/CA due to IEEE802.11 wireless LAN standard, setting the direct-current biased voltage to be applied across the control electrode connected with a predetermined semi-conductive antenna body in the antenna device allows a carrier sense to be performed by using the omnidirectional antenna that has been formed by the semi-conductive antenna bodies that have been switched to their conductive states or their insulated states.

Further, setting the direct-current biased voltage applied across each of the control electrodes connected with the semi-conductive antenna bodies in the antenna device allows a directional antenna to be formed by combining a waveguide and a reflector which are formed of the semi-conductive antenna bodies that have been switched to their conductive states or their insulated states. This enables any feedback setting on the direct-current biased voltage applied across the control electrodes to be implemented by guiding any wireless communication condition to a wireless communication apparatus of a destined node.

Thus, by the embodiment of the control method according to the invention, it is possible to adjust directivity/omnidirectivity, radiated polarization and radiation direction of the antenna device to desired ones without making the wireless communication apparatus large-scaled and/or expensive, thereby enabling optimal condition of any transmission performance to a wireless communication apparatus of a destined node to be maintained. This allows any wireless communication according to CSMA/CA or the like to be performed.

According to additional embodiments of the invention, there are provided a program product allowing a computer to carry out the above control method of controlling the wireless communication apparatus and the computer-readable storage medium that stores the above control method of controlling the wireless communication apparatus.

In these embodiments of the program product and the computer-readable storage medium according to the invention, a computer including a microcomputer, CPU, and a signal-processing LSI can perform any processes running the program product and using the storage medium. Thus, it is possible to adjust directivity/omnidirectivity, radiated polarization and radiation direction of the antenna device to desired ones with good reproducibility without making the antenna device large-scaled and/or expensive, thereby enabling optimal condition of any transmission performance to a wireless communication apparatus of a destined node to be maintained. This allows any wireless communication according to CSMA/CA or the like to be performed.

The concluding portion of this specification particularly points out and directly claims the subject matter of the present invention. However that skill in the art will best understand both the organization and method of operation of the invention, together with further advantages and objects thereof, by reading the remaining portions of the specification in view of the accompanying drawing(s) wherein like reference characters refer to like elements.

DETAILED DESCRIPTION OF PREFERRED EMBODIMENTS

Figure 1:
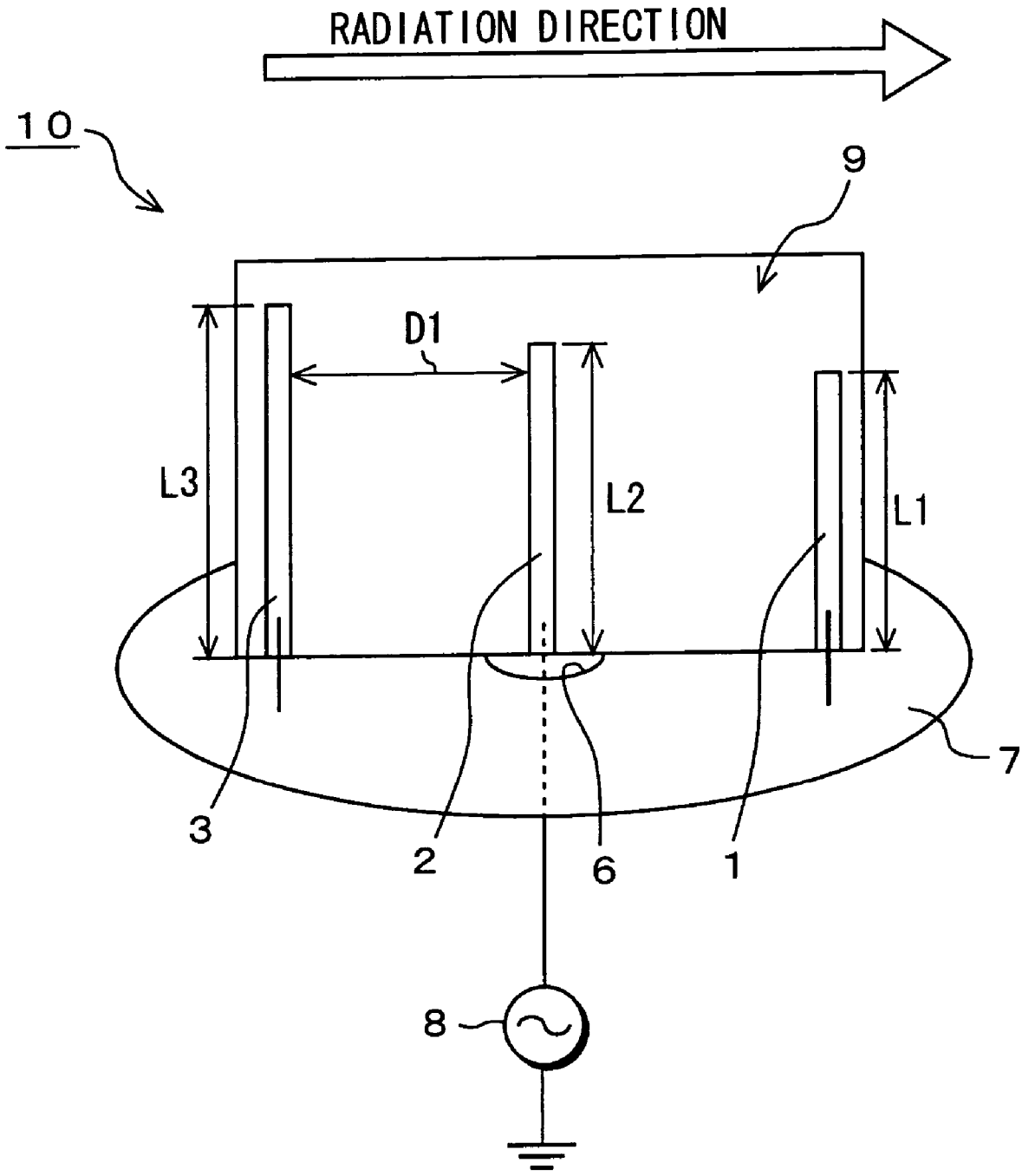
FIG. 1 (RELATED ART)
FIG. 1 is a diagram for illustrating a configuration of a Yagi antenna device of monopole type relative to related art.
Figure 2:
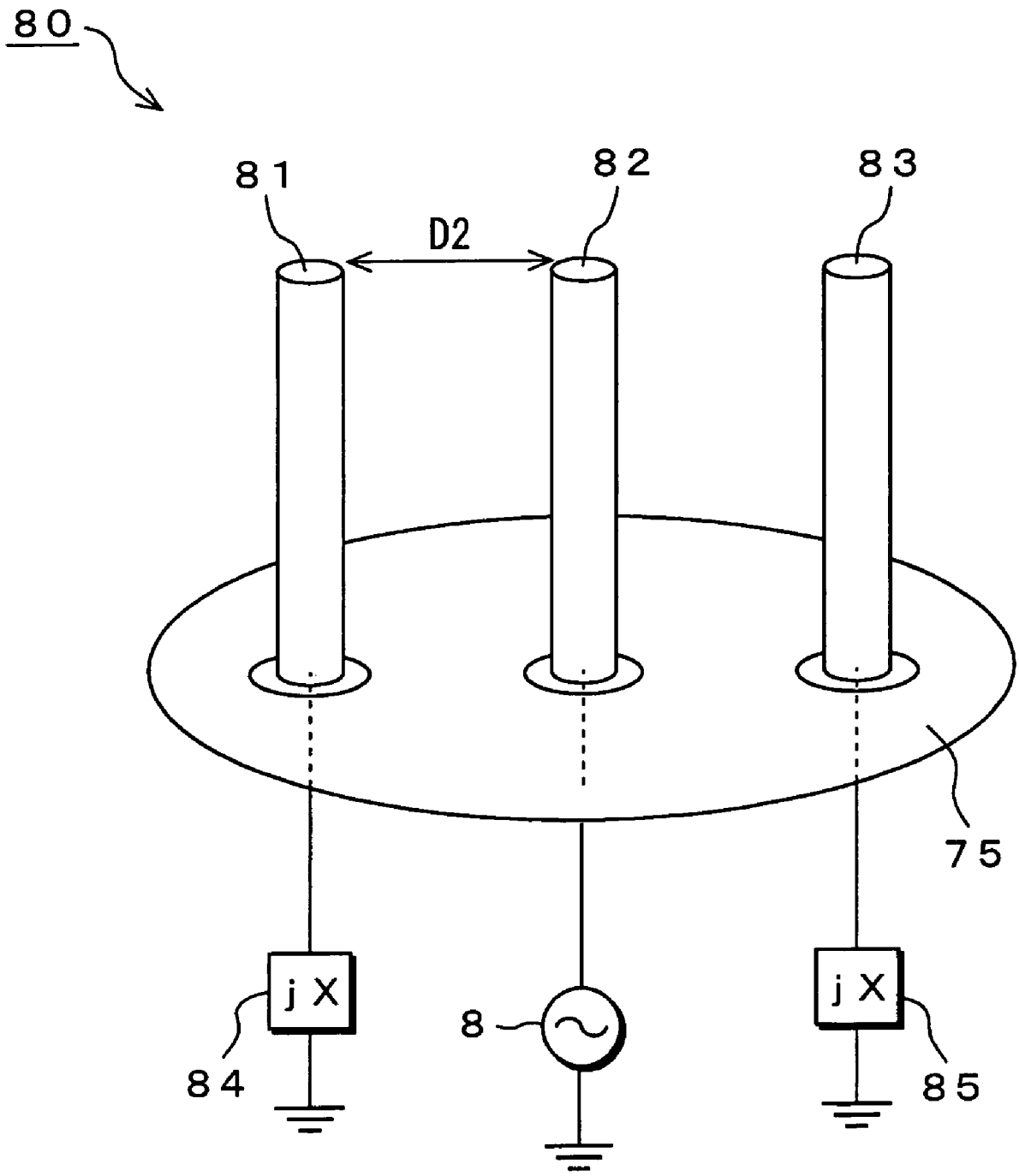
FIG. 2 (RELATED ART)
FIG. 2 is a conceptual illustration for illustrating a configuration of an antenna device with beamforming functions.

Referring now to the drawings, an antenna device, a wireless communication apparatus, a control method of controlling the wireless communication apparatus, a program product therefor, and a computer-readable storage medium therefor according to preferred embodiments of the invention will be described specifically below.

Figure 3:
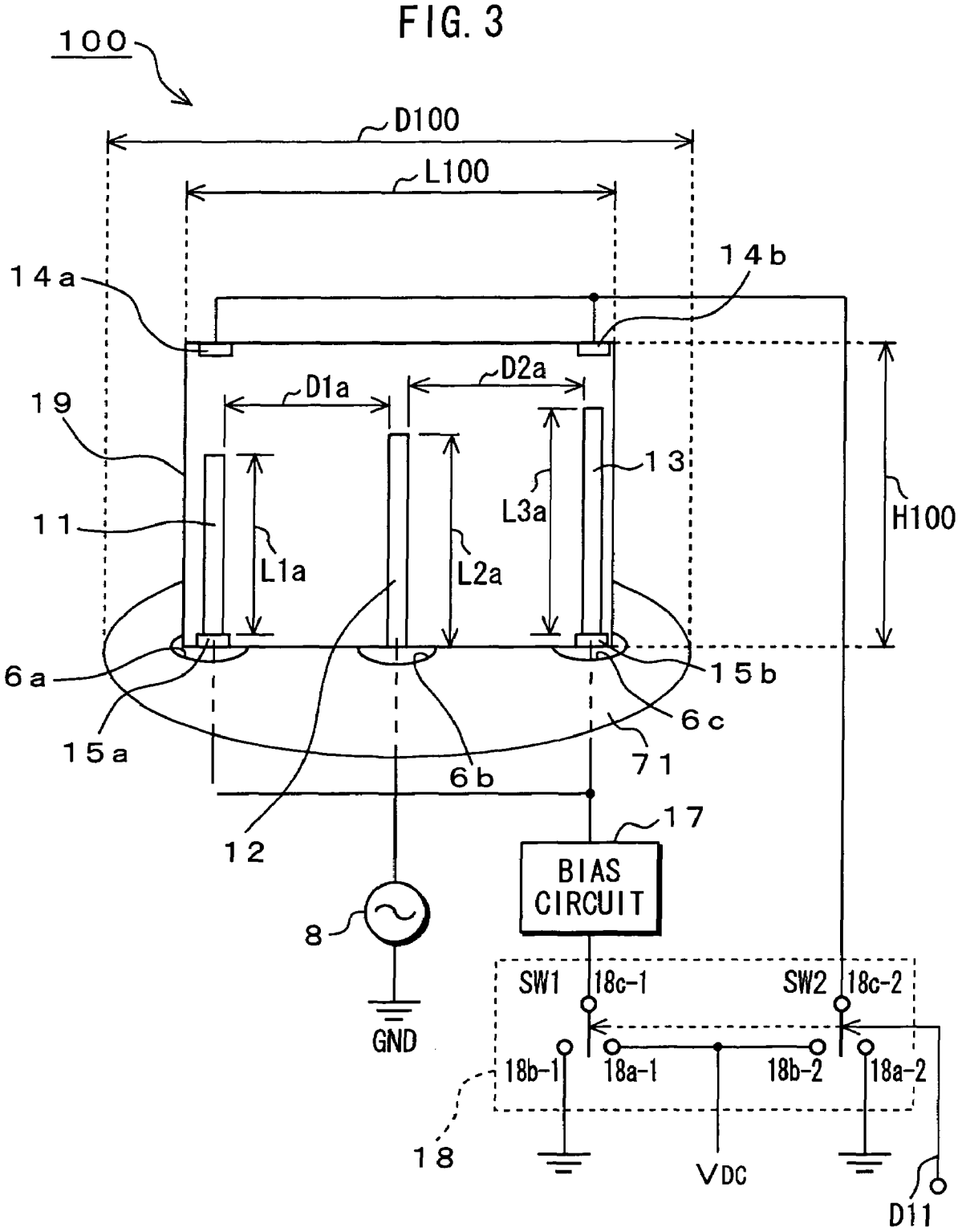
FIG. 3 is a diagram for illustrating a configuration of a Yagi antenna device of monopole type according to a first embodiment of the invention.

FIG. 3 illustrates a configuration of a Yagi antenna device 100 of monopole type according to a first embodiment of the invention.

The Yagi antenna device 100 shown in FIG. 3 has a base disk 71 as a base plate for grounding, and a dielectric substrate 19 having antenna bodies. The base disk 71 is constituted of a printed board having a diameter D100. The base disk 71 has at predetermined positions three openings 6*a*, 6*b*, 6*c* through which control wires are passed.

The dielectric substrate 19 is positioned on the base disk 71 with them being intersected with each other. The dielectric substrate 19 has, for example, a height of H100 and a length of L100. The dielectric substrate 19 is made of solid electrolyte material selected from silicon gel, acrylonitrile gel, polysaccharide polymer and the like, which are used for a lithium ion battery or the like. The solid electrolyte material is subject to anion movement. The antenna bodies include a parasitic antenna element 11 for a waveguide, which has a predetermined length L1*a*, an excited antenna element 12 for a feeder, which has a length L2*a*, and a parasitic antenna element 13 for a reflector, which has a length L3*a*. These antenna elements 11, 12, 13 are arranged and patterned on the dielectric substrate 19 in order. Each of the antenna elements 11, 12, 13 has a length corresponding to a wavelength of a frequency within any one of a millimeter wave band, a micrometer wave band, and an ultra-high frequency (UHF) band. They have a relationship on their lengths indicated by L1*a*<L2*a*<L3*a*.

For example, if radio wave having a wavelength of $\lambda$ is radiated from the Yagi antenna device 100, the length L2*a* of the excited antenna element (monopole element) 12 is a quarter wavelength long. The excited antenna element 12 is made of metallic material such as copper, bronze, and gold. Such the metallic material is patterned by any of their foils. The parasitic antenna element 11 is away from the excited antenna element 12 by a distance D1*a*, for example, a quarter wavelength long. Similarly, the parasitic antenna element 13 is away from the excited antenna element 12 by a distance D2*a*, for example, a quarter wavelength long.

The parasitic antenna elements are respectively made of semi-conductive plastic material. Such the semi-conductive plastic material is made so that any species of ion is doped into an insulating resin in order to obtain same conductivity as metal. As the semi-conductive plastic material, polyacetylene, polythiophene, polyaniline, polypyrrol, polyazulene, and the like are used.

In this embodiment, if direct-current biased voltage that has a desired direction is applied across a layer of the semi-conductive plastic material and a layer of the solid electrolyte material, ion can be moved according to the direction of the applied voltage. Thus, the semi-conductive plastic material is made conductive or insulated. This embodiment of the invention utilizes such this behavior of the semi-conductive plastic material.

The parasitic antenna element 11 is provided with a control electrode 15*a* at its one end, which meets a side of the dielectric substrate 19. Similarly, the parasitic antenna element 13 is provided with a control electrode 15*b* at its one end, which meets the side of the dielectric substrate 19. In this embodiment, direct-current biased voltage is applied across each of the control electrodes 15*a*, 15*b*. The direct-current biased voltage applied across each of the control electrodes 15*a*, 15*b* is controlled to switch each of the semi-conductive antenna elements 11, 13 between their insulation state and their conductive state.

The excited antenna element 12 is connected to a signal source 8 via a wired line extending from the excitation antenna element 12 to an end of the signal source 8 though the opening 6*b*. The signal source 8 feeds a transmission signal to the excited antenna element 12 through the wired line. The other end of the signal source 8 is grounded. The control electrodes 15*a*, 15*b* are respectively connected to a bias circuit 17 via wired lines extending from the control electrodes 15*a*, 15*b* to an end of the bias circuit 17 though the openings 6*a*, 6*c*. The bias circuit 17 applies the direct-current biased voltage across each of the control electrodes 15*a*, 15*b* connected with the parasitic antenna elements 11, 13.

In this embodiment, the Yagi antenna device 100 uses the signal source 8, the bias circuit 17 and a switch circuit 18 with them being combined. The other end of the bias circuit 17 as well as control terminals 14*a*, 14*b* are connected to the switch circuit 18. The switch circuit 18 has switches SW1, SW2. The switch circuit 18 changes over its switches based on switch control data D11. The switch SW1, SW2, respectively, have contact points 18*a*-1, 18*b*-1, 18*a*-2, 18*b*-2 and a middle fixed point 18*c*-1, 18*c*-2.

The middle fixed point 18*c*-1 of the switch SW1 is connected to the bias circuit 17. The contact point 18*a*-1 of the switch SW1 is connected to a driving power supply, not shown. The contact point 18*b*-1 of the switch SW1 is grounded. If the switch SW1 selects its contact point 18*a*-1, its middle fixed point 18*c*-1 is connected to this contact point 18*a*-1 so that driving voltage VDC can be applied across the bias circuit 17. If the switch SW1 selects its contact point 18*b*-1, its middle fixed point 18*c*-1 is connected to this contact point 18*b*-1 so that the bias circuit 17 can be grounded.

The middle fixed point 18*c*-2 of the switch SW2 is connected to each of the control terminals 14*a*, 14*b*. The contact point 18*a*-2 of the switch SW2 is grounded. If the switch SW2 selects its contact point 18*a*-2, its middle fixed point 18*c*-2 is connected to this contact point 18*a*-2 so that the parasitic antenna elements 11, 13 can be grounded through the control terminals 14*a*, 14*b*. The contact point 18*b*-2 of the switch SW2 is connected to a driving power supply, not shown. If the switch SW2 selects its contact point 18*b*-2, its middle fixed point 18*c*-2 is connected to this contact point 18*b*-2 so that the driving voltage VDC can be applied across the parasitic antenna elements 11, 13 through the control terminals 14*a*, 14*b*.

Figure 4:
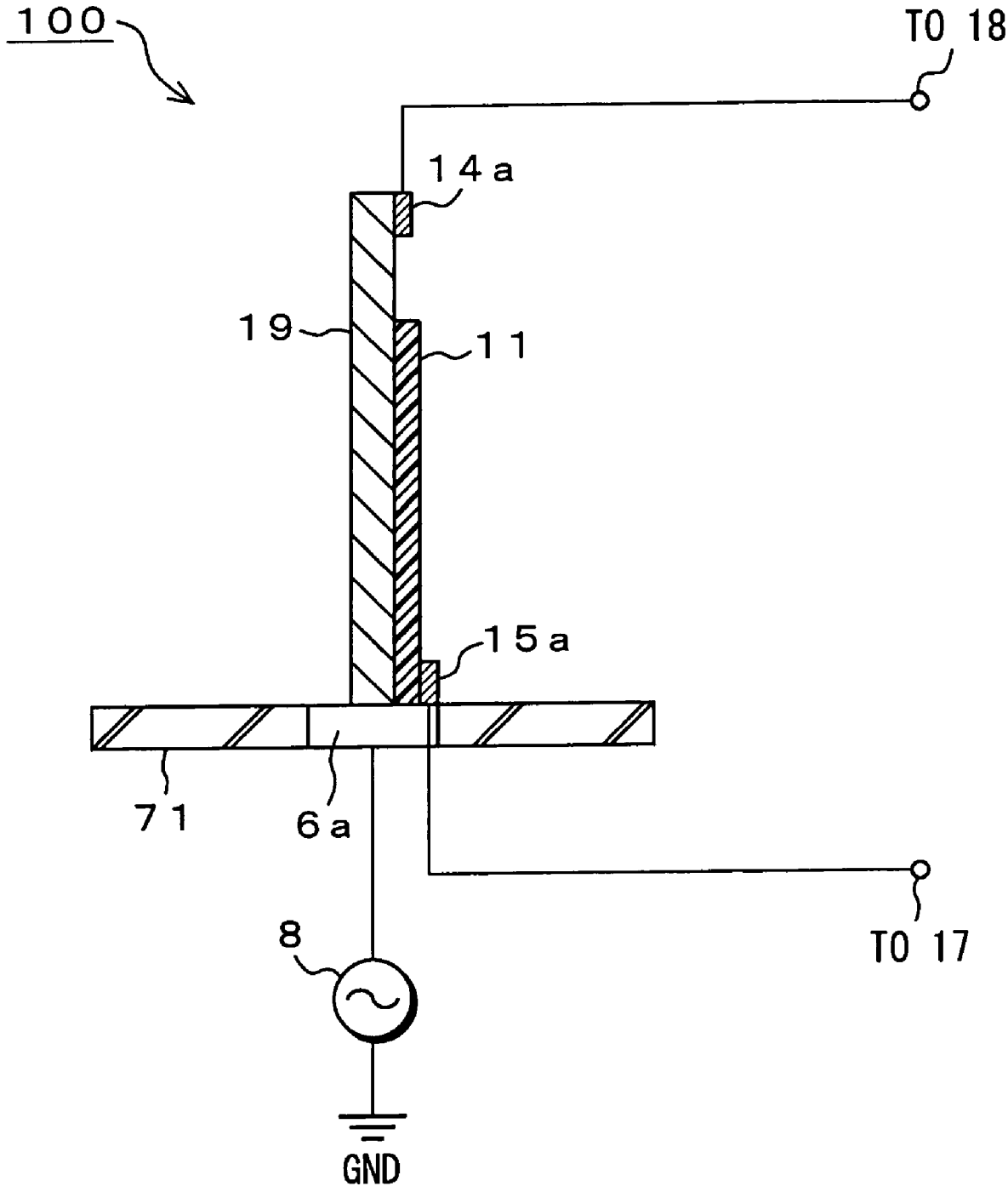
FIG. 4 is a sectional view of a part of the Yagi antenna device according to the first embodiment of the invention using semi-conductive plastic material and solid electrolyte substrate.

FIG. 4 illustrates a sectional view of a part of the Yagi antenna device 100 according to the first embodiment of the invention using the semi-conductive plastic material and the solid electrolyte substrate.

The Yagi antenna device 100 has a junction (laminated) structure. The Yagi antenna device 100 has two-layer structure constituting of the solid electrolyte layer of the dielectric substrate 19 and semi-conductive plastic layer of the parasitic antenna element 11. In this embodiment, the dielectric substrate 19 is positioned on the base disk 71 with them being intersected with each other. The dielectric substrate 19 is arranged on the base disk 71 across the opening 6*a* and the like. Solid electrolyte material is used as the dielectric substrate 19.

The antenna bodies such as the parasitic antenna element 11 are formed on the dielectric substrate 19 by patterning the semi-conductive plastic material thereto. To this semi-conductive plastic layer, any dopant (electron $e^-$; ion) doped into the solid electrolyte material constituting the dielectric substrate 19 is moved.

The control electrode 15*a* is arranged on a lower end of the parasitic antenna element 11. The control electrode 15*a* is connected to the bias circuit 17 by the wired line extending from control electrode 15*a* to an end of the bias circuit 17 through the opening 6*a*. Through the control electrode 15*a*, the direct-current biased voltage is supplied to the parasitic antenna element 11. The control terminal 14*a* is arranged on an upper end of the dielectric substrate 19. The control terminal 14*a* is connected to the switch circuit 18 shown in FIG. 3 via the wired line extending from the control terminal 14*a* to the switch circuit 18. Through the control terminal 14*a*, the direct-current biased voltage is also supplied to the dielectric substrate 19.

Although the Yagi antenna device 100 has been described to have the two layer structure, the invention is not limited thereto. The Yagi antenna device 100 can have a five-layer structure so that it can have a first layer made of semi-conductive plastic material, which patterns antenna elements as a part of the antenna; a second layer made of solid electrolyte material; a third layer made of solid electrolyte material; a fourth layer for separating the second and third layers; and a fifth layer made of semi-conductive plastic material, which patterns antenna elements as the other part of the antenna.

Thus, in this embodiment, according to an applied direction of the direct-current biased voltage across a junction structure of the solid electrolyte layer and the semi-conductive plastic layer, the semi-conductive plastic layer is made conductive or insulated by moving ion. Such the nature is applied to the parasitic antenna elements 11, 13 and the like in the embodiment in order to control a directivity of the antenna device.

Figure 5A:
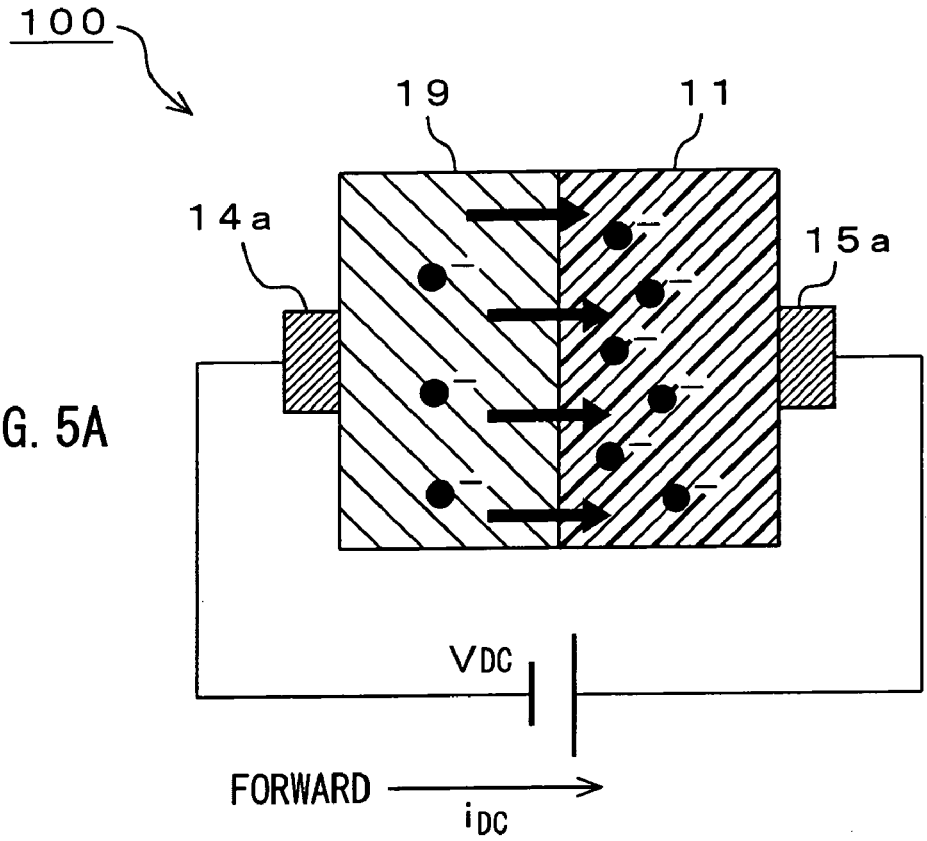
FIGS. 5A and 5B are sectional drawings each for explaining a control example of making a parasitic antenna element for waveguide conductive or insulated.
Figure 5B:
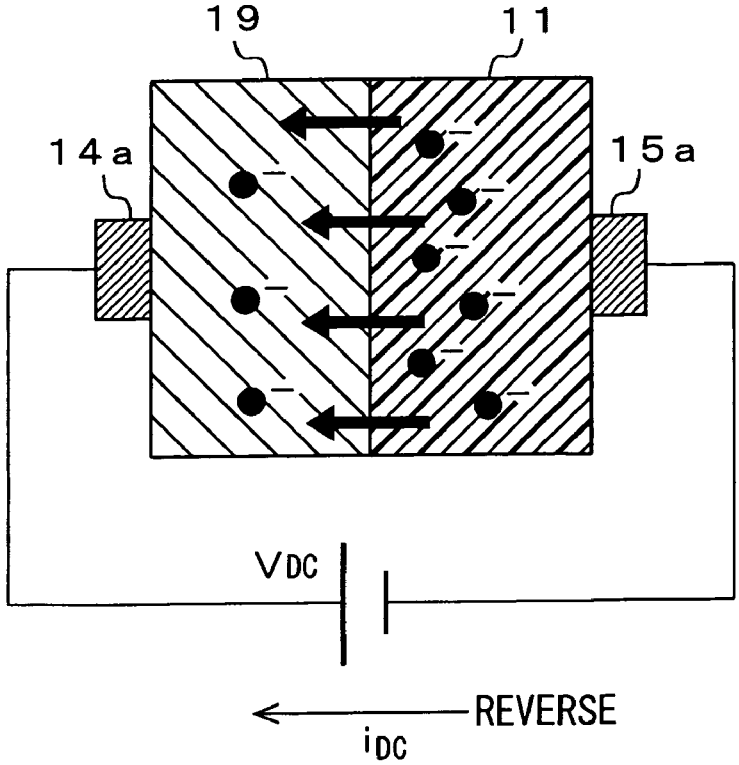

FIGS. 5A and 5B are sectional drawings each for explaining a control example of making the parasitic antenna element 11 for a waveguide conductive or insulated. In this embodiment, each of the parasitic antenna elements 11, 13 is made conductive or insulated so that the antenna device can be controlled to configure a directional antenna or an omnidirectional antenna.

A junction configuration shown in FIG. 5A indicates a portion of the parasitic antenna element 11 mounted on the dielectric substrate 19 as shown in FIG. 4.

On the junction configuration shown in FIG. 5A, forward biased voltage is applied across the control electrode 15*a* of the parasitic antenna element 11 and the control terminal 14*a* of the dielectric substrate 19. When such the forward biased voltage is applied thereacross, the anion (electron) is moved from the dielectric substrate 19, which is made of solid electrolyte material, to the parasitic antenna element 11, which is made of semi-conductive plastic material. This enables the parasitic antenna element 11 to be made conductive, thereby changing its electric nature so as to allow electricity to pass through it like metal. Thus, the parasitic antenna element 11 can act as a waveguide in Yagi antenna device 100.

Relative to the parasitic antenna element 13, which is not shown, when the forward biased voltage is applied across the control electrode 15*b* and the control terminal 14*b* of the dielectric substrate 19, this also enables the parasitic antenna element 13 to be made conductive, thereby changing its electric nature so as to allow electricity to pass through it like metal. Thus, the parasitic antenna element 13 can act as a reflector in Yagi antenna device 100. This allows the Yagi antenna device 100 to have a directivity thereof.

Contrarily, if, on the junction configuration shown in FIG. 5B, reverse biased voltage is applied across the control electrode 15*a* of the parasitic antenna element 11 and the control terminal 14*a* of the dielectric substrate 19, the anion is moved from the parasitic antenna element 11 to the dielectric substrate 19. This enables the parasitic antenna element 11 to be made insulated, thereby changing its electric quality so as to prevent electricity from passing through it like insulation.

Thus, the parasitic antenna element 11 is prevented from acting as a waveguide in Yagi antenna device 100.

Relative to the parasitic antenna element 13, which is not shown, the parasitic antenna element 13 is also prevented from acting as a reflector in Yagi antenna device 100. This allows the Yagi antenna device 100 to have an omnidirectivity thereof.

Figure 6:
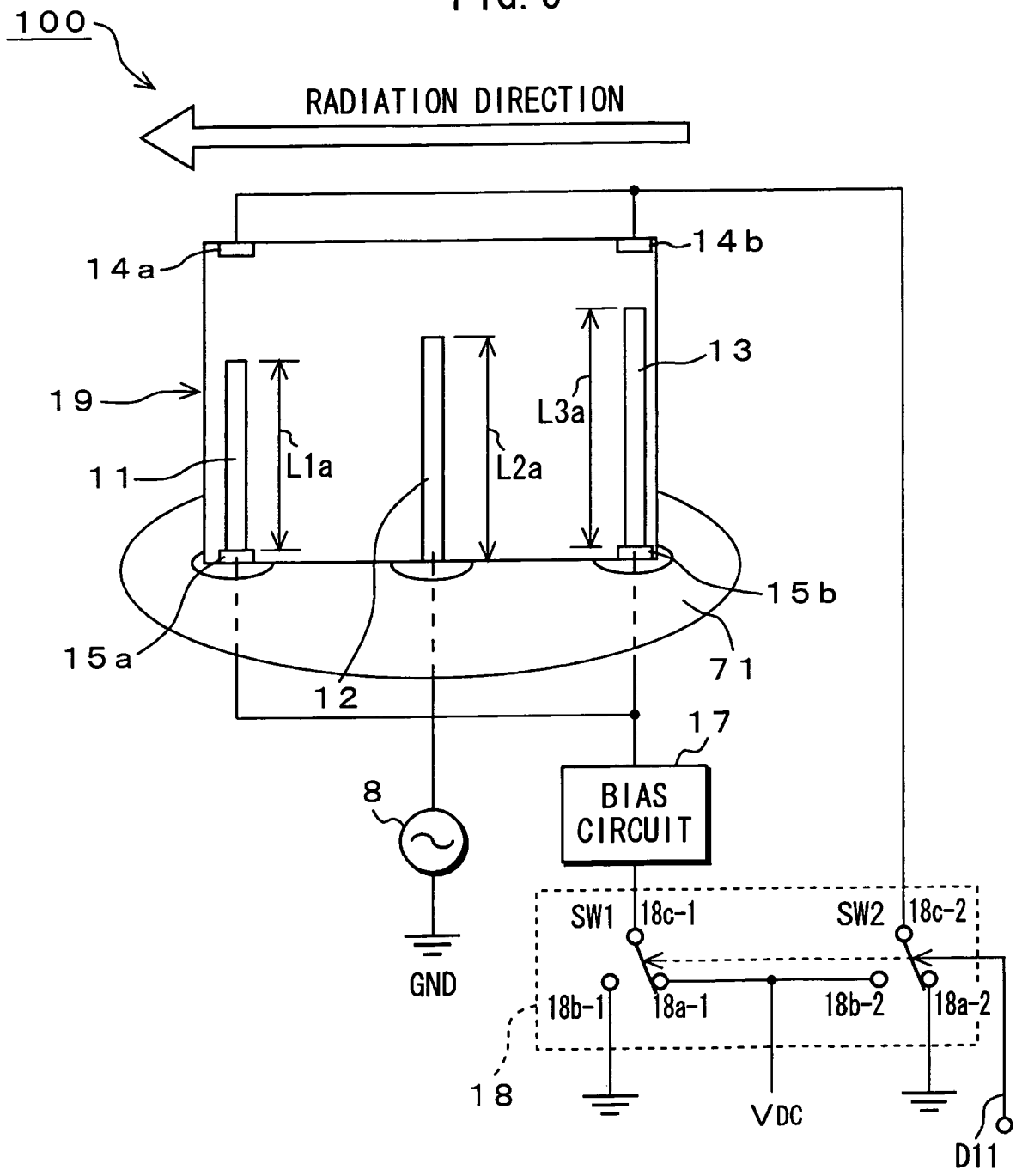
FIG. 6 is a diagram for showing an operational example (as a directional antenna) of the Yagi antenna device as shown in FIG. 3.

FIG. 6 shows an operational example (as a directional antenna) of the Yagi antenna device 100. In this embodiment, the Yagi antenna device 100 has two line parasitic antenna elements 11, 13 having different lengths (L1*a*, L3*a*), which are positioned on both sides of the dielectric substrate 19, and a conductive excited antenna element 12 having a length L2*a* (L1*a*<L2*a*<L3*a*), which is arranged on a center of the dielectric substrate 19 with the conductive excited antenna element 12 being away from each of the line parasitic antenna elements 11, 13 by a predetermined distance. In the Yagi antenna device 100, the signal source 8 feeds a transmission signal into the excited antenna element 12. Forward direct-current biased voltage is applied across each of the control electrodes 15*a*, 15*b* of the parasitic antenna elements 11, 13.

Under such the situation, in order to allow the Yagi antenna device 100 to have directivity thereof, a control system, not shown, supplies the switch circuit 18 with the switch control data D11 that enables the Yagi antenna device 100 to have directivity thereof. For example, contents of the switch control data D11 include selection of both of the contact points 18*a*-1, 18*a*-2 of the switches SW1, SW2.

In the switch circuit 18, when the switch SW1 selects its contact point 18*a*-1, its middle fixed point 18*c*-1 is connected to this contact point 18*a*-1 based on the switch control data D11 so that the driving voltage VDC can be applied across the bias circuit 17. At the same time, the switch SW2 selects its contact point 18*a*-2 so that its middle fixed point 18*c*-2 can be connected to this contact point 18*a*-2. The dielectric substrate 19 is grounded through the control terminals 14*a*, 14*b*.

In this moment, the forward direct-current biased voltage VDC is applied across the control electrode 15*a* of the parasitic antenna element 11 and the control terminal 14*a* of the dielectric substrate 19. The forward direct-current biased voltage VDC is also applied across the control electrode 15*b* of the parasitic antenna element 13 and the control terminal 14*b* of the dielectric substrate 19.

When such the forward direct-current biased voltage VDC is supplied to the control electrodes 15*a*, 15*b* through the bias circuit 17, anion (electron) is moved from the dielectric substrate 19 made of solid electrolyte material to the antenna elements 11, 13 made of the semi-conductive plastic parasitic material, thereby enabling both of the antenna elements 11, 13 to be made conductive. Thus, nature of each of the antenna elements 11, 13 is changed to any conductive one like metal.

In this Yagi antenna device 100, the parasitic antenna element 11 acts as a waveguide and the parasitic antenna element 13 acts as a reflector. Thus, the Yagi antenna device 100 can have a directivity like a radiation direction as an arrow shown in FIG. 6.

Figure 7:
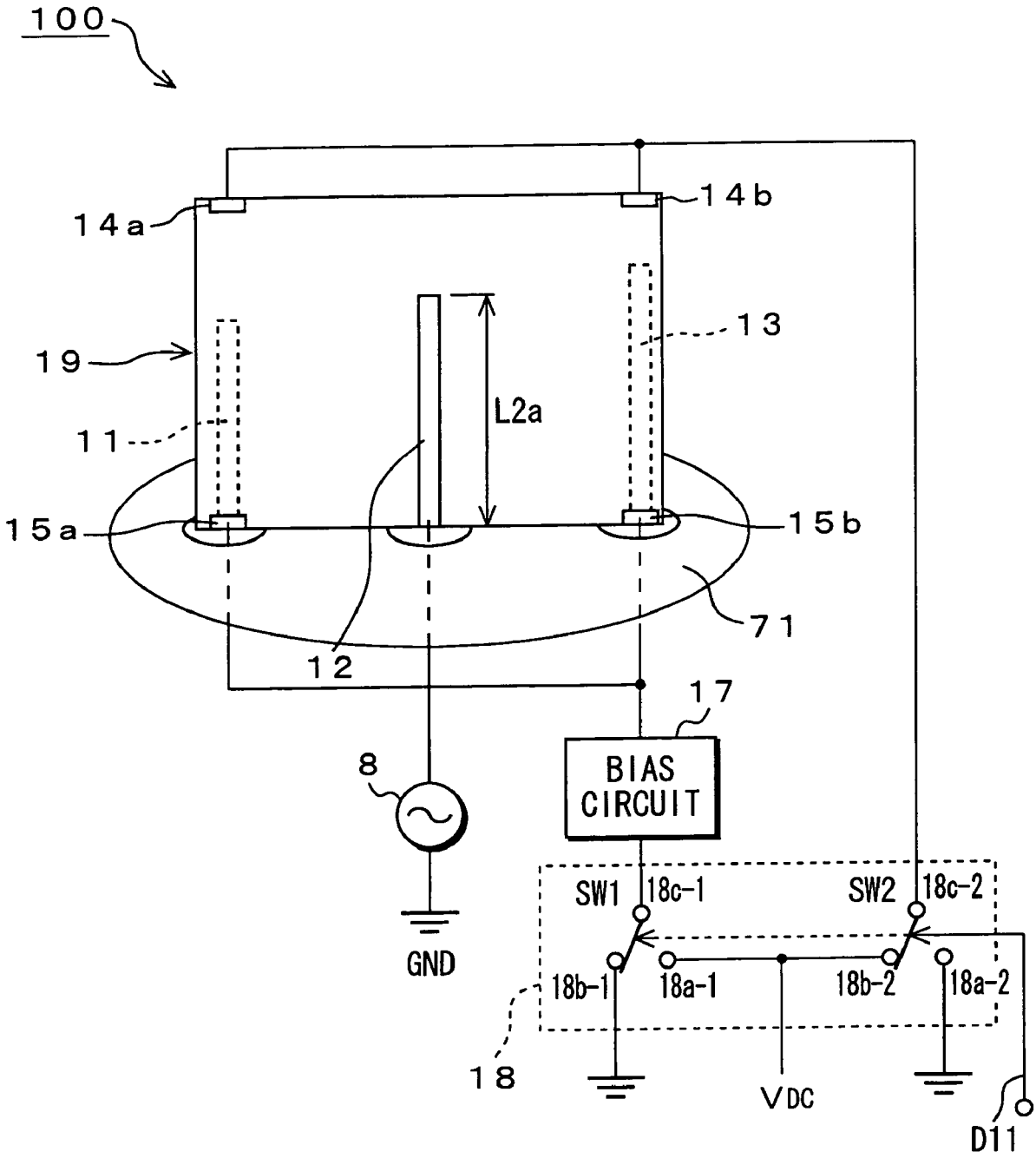
FIG. 7 is a diagram for showing an operational example (as an omnidirectional antenna) of the Yagi antenna device as shown in FIG. 3.

FIG. 7 shows an operational example (as an omnidirectional antenna) of the Yagi antenna device 100. In this embodiment, in the Yagi antenna device 100, the signal source 8 feeds a transmission signal into the excited antenna element 12. Reverse direct-current biased voltage is applied across each of the control electrodes 15*a*, 15*b* of the parasitic antenna elements 11, 13. If, as shown in FIG. 5B, the reverse direct-current biased voltage moves anion (electron) from the antenna elements 11, 13 to the dielectric substrate 19, both of the antenna elements 11, 13 can be made insulated. In this moment, only the middle excited antenna element 12 is actuated to configure a monopole antenna so that the antenna device 100 can have an omnidirectivity.

Under such the situation, in order to allow the Yagi antenna device 100 to have the omnidirectivity, a control system, not shown, supplies the switch circuit 18 with the switch control data D11 that enables the Yagi antenna device 100 to have the omnidirectivity. For example, contents of the switch control data D11 include selection of both of the contact points 18*b*-1, 18*b*-2 of the switches SW1, SW2.

In the switch circuit 18, when the switch SW1 selects its contact point 18*b*-1, its middle fixed point 18*c*-1 is connected to this contact point 18*b*-1 based on the switch control data D11 so that the bias circuit 17 can be grounded. At the same time, the switch SW2 selects its contact point 18*b*-2 so that its middle fixed point 18*c*-2 can be connected to this contact point 18*b*-2. The driving voltage VDC can be applied across the dielectric substrate 19 through the control terminals 14*a*, 14*b*.

The reverse direct-current biased voltage VDC is applied across the control electrode 15*a* of the parasitic antenna element 11 and the control terminal 14*a* of the dielectric substrate 19. The reverse direct-current biased voltage VDC is also applied across the control electrode 15*b* of the parasitic antenna element 13 and the control terminal 14*b* of the dielectric substrate 19.

When the bias circuit 17 supplies the control electrodes 15*a*, 15*b* with such the reverse direct-current biased voltage VDC, anion (electron) is moved from the antenna elements 11, 13 made of the semi-conductive plastic parasitic material to the dielectric substrate 19 made of solid electrolyte material, thereby enabling both of the antenna elements 11, 13 to be made insulated. Thus, nature of each of the antenna elements 11, 13 is changed to any insulated one like insulation.

In this Yagi antenna device 100, the parasitic antenna element 11 is prevented from acting as a waveguide and the parasitic antenna element 13 is also prevented from acting as a reflector. Thus, the Yagi antenna device 100 can have the omnidirectivity.

Thus, according to the Yagi antenna device 100 as the first embodiment of the invention, the two line parasitic antenna elements 11, 13 having different lengths L1, L3, are positioned on both sides of the dielectric substrate 19 and the conductive excited antenna element 12 having a length L2, is arranged on a center of the substrate. The conductive excited antenna element 12 is away from each of the line parasitic antenna elements 11, 13 by a predetermined distance. The control electrodes 15*a*, 15*b* are respectively connected to the parasitic antenna elements 11, 13 and the direct-current biased voltage is applied across each of the control electrodes 15*a*, 15*b*. Such the direct-current biased voltage is controlled to switch each of the parasitic antenna elements 11, 13 between their insulation state and their conductive state.

In this embodiment, when making the parasitic antenna elements 11, 13 conductive, the forward direct-current biased voltage moves any ions from the dielectric substrate 19 to the parasitic antenna elements 11, 13. When making the parasitic antenna elements 11, 13 insulated, the reverse direct-current biased voltage moves any ions from the parasitic antenna elements 11, 13 to the dielectric substrate 19.

Thus, when combining the two parasitic antenna elements 11, 13 made conductive according to this embodiment, it is possible to configure a directional antenna including a wave guide and a reflector. When making the two parasitic antenna elements 11, 13 as the waveguide and the reflector insulated and remaining only the excited antenna element 12 in this directional antenna, it is possible to configure an omnidirectional antenna. This enables the Yagi antenna device 100 to be controlled so that its directivity/omnidirectivity can be adjusted to desired one without making the Yagi antenna device 100 large-scaled and/or expensive. Further, in the wireless LAN, it is possible to use the omnidirectional antenna thereof when performing a carrier sense and to use the directional antenna thereof when performing any communication, without increasing numbers of the antennas to be set.

Figure 8:
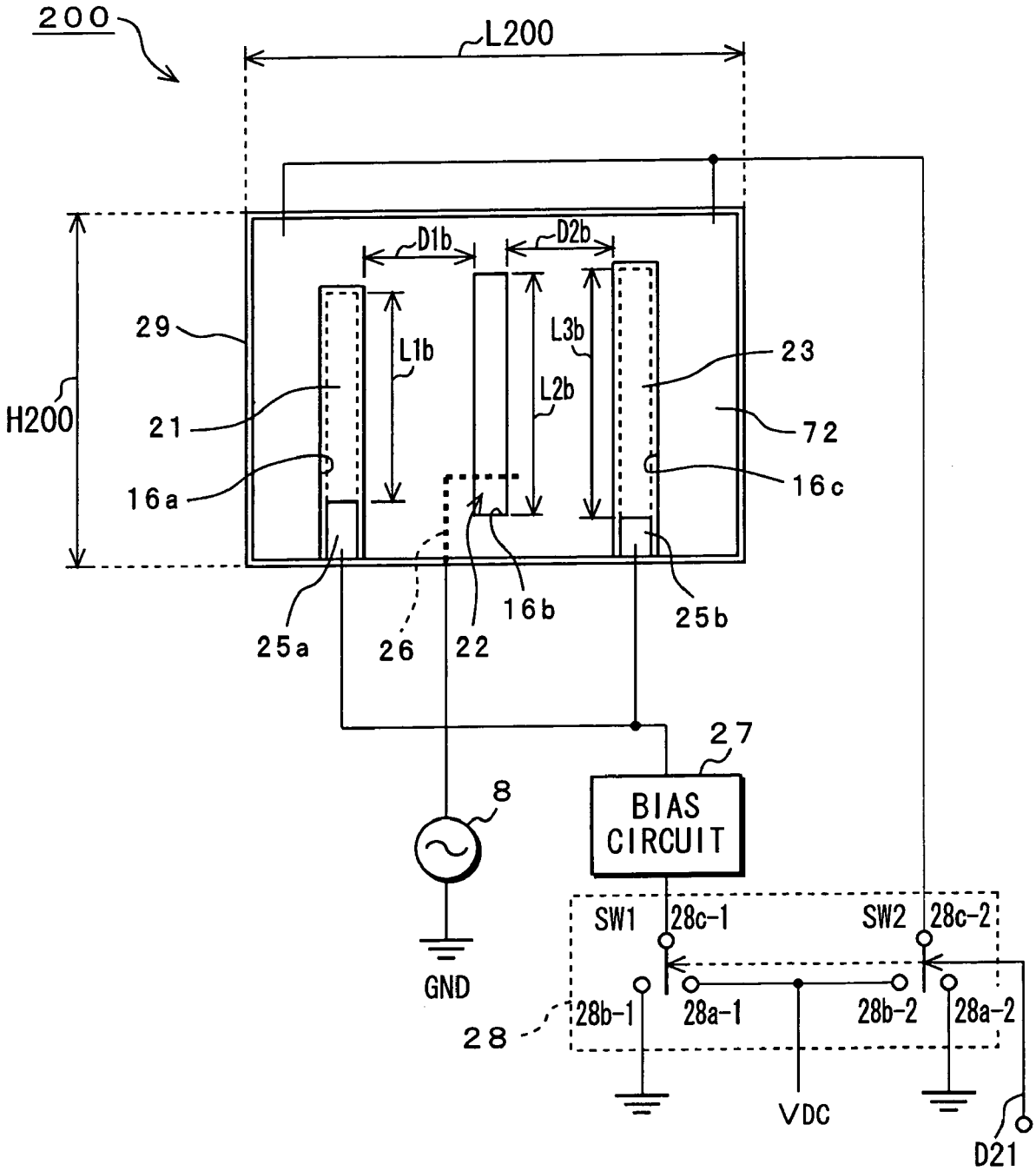
FIG. 8 is a diagram for illustrating a configuration of a Yagi antenna device of slot type according to a second embodiment of the invention.

FIG. 8 illustrates a configuration of a Yagi antenna device 200 of slot type according to a second embodiment of the invention. In this embodiment, the Yagi antenna device 200 has a conductive antenna pattern (hereinafter, referred to as "a base plate 72") on a dielectric substrate 29. The conductive base plate 72 has two slots (hereinafter, referred to as "parasitic antenna slots 16*a*, 16*c*") that expose two semi-conductive parasitic antenna elements 21, 23, respectively, and one slot (hereinafter, referred to as "an excited antenna slot 16*b*") acting as an excited antenna element 22, which is arranged with it being positioned between the two parasitic antenna slots 16*a*, 16*c* with predetermined distances D1*b*, D2*b*. The excited antenna slot 16*b* is fed. Forward or reverse biased voltage is applied across each of the control electrodes 25*a*, 25*b* connected with the parasitic antenna elements 21, 23 in the parasitic antenna slots 16*a*, 16*c*.

In the Yagi antenna device 200, the dielectric substrate 29 having antenna elements is combined with the metallic base plate 72 constituting the antenna pattern. The base plate 72 has a rectangular shape which covers the whole dielectric substrate 29. For example, the base plate 72 has the excited antenna slot 16*b* acting as the excited antenna element 22 at a middle position thereof and the parasitic antenna slots 16*a*, 16*c* for the parasitic antenna elements 21, 23 at both sides thereof. The base plate 72 is constituted of metallic pattern such as copper pattern, bronze pattern, and SUS pattern.

Behind the base plate 72, the dielectric substrate 29 is positioned. The dielectric substrate 29 has, for example, a height of H200 and a length of L200. Similar to the first embodiment of the invention, the dielectric substrate 29 is made of solid electrolyte material selected from silicon gel, acrylonitrile gel, polysaccharide polymer and the like, which are used for a lithium ion battery or the like. The solid electrolyte material is subject to anion movement.

The dielectric substrate 29 has antenna bodies. The antenna bodies include the parasitic antenna element 21 for a waveguide, which has a predetermined length L1*b*, and the parasitic antenna element 23 for a reflector, which has a length L3*b*.

The excited antenna slot 16*b* for a feeder has a length L2*b*. The antenna slots 16*a*, 16*b*, 16*c* are formed in the base plate 72 in order. The parasitic antenna slots 16*a*, 16*c*, respectively, expose the parasitic antenna elements 21, 23.

Each of the parasitic antenna elements 21, 23 and the excited antenna slot 16*b* has a length corresponding to a wavelength of a frequency within any one of a millimeter wave band, a micrometer wave band, and an ultra-high frequency (UHF) band. Their lengths have a relationship indicated by L1*b*<L2*b*<L3*b*. For example, if radio wave having a wavelength of λ is radiated from the Yagi antenna device 200, the length L2*b* of the excited antenna slot 16*b* is a half wavelength long.

The parasitic antenna slot 16*a* is away from the excited antenna slot 16*b* by a distance D1*b*, for example, a quarter wavelength long. Similarly, the parasitic antenna slot 16*c* is away from the excited antenna slot 16*b* by a distance D2*b*, for example, a quarter wavelength long.

The parasitic antenna elements 21, 23 are respectively made of semi-conductive plastic material. Such the semi-conductive plastic material is made so that any species of ion is doped into an insulating resin in order to obtain same conductivity as metal. As the semi-conductive plastic material, polyacetylene, polythiophene, polyaniline, polypyrrol, polyazulene and the like are used.

In this embodiment, if direct-current biased voltage that has a desired direction is applied across a layer of the semi-conductive plastic material and a layer of the solid electrolyte material, ion can be moved according to a direction of the applied voltage. This enables the semi-conductive plastic material to be made conductive or insulated. This embodiment of the invention utilizes such the behavior of the semi-conductive plastic material.

The parasitic antenna slots 16*a*, 16*c* have open at a side of the dielectric substrate 29. The control electrode 25*a* is connected with an end of the parasitic antenna element 21 and is positioned at an exit of the parasitic antenna slot 16*a*. Similarly, the control electrode 25*b* is connected with an end of the parasitic antenna element 23 and is positioned at an exit of the parasitic antenna slot 16*c*. In this embodiment, direct-current biased voltage is applied across each of the control electrodes 25*a*, 25*b*. The direct-current biased voltage is controlled to switch each of the semi-conductive parasitic antenna elements 21, 23 between their insulation state and their conductive state.

The excited antenna slot 16*b* is connected to a signal source 8 via a feeding line (micro strip line) 26 extending to an end of the signal source 8. A part of the feeding line 26 extends in a direction orthogonal to a longitudinal direction of the parasitic antenna slot 16*b* on the rear surface of the dielectric substrate 29. The signal source 8 feeds a transmission signal to the excited antenna slot 16*b* through the feeding line 26, thereby enabling the excited antenna slot 16*b* to act as the excited antenna element 22. The other end of the signal source 8 is grounded.

The control electrodes 25*a*, 25*b* are respectively connected to a bias circuit 17 via wired lines extending from the control electrodes 25*a*, 25*b* to an end of the bias circuit 17 through the exits of the parasitic antenna slots 16*a*, 16*c*. The bias circuit 27 applies the direct-current biased voltage across each of the control electrodes 25*a*, 25*b* connected with the parasitic antenna elements 21, 23.

In this embodiment, the Yagi antenna device 200 uses the signal source 8, the bias circuit 27 and a switch circuit 28 with them being combined. The other end of the bias circuit 27 as well as the base plate 72 are connected to the switch circuit 28. The switch circuit 28 has switches SW1, SW2. The switch circuit 18 changes over its switches based on switch control data D21. The switches SW1, SW2, respectively, have contact points 28*a*-1, 28*b*-1, 28*a*-2, 28*b*-2 and a middle fixed point 28*c*-1, 28*c*-2.

The middle fixed point 28*c*-1 of the switch SW1 is connected to the bias circuit 27. The contact point 28*a*-1 of the switch SW1 is connected to a driving power supply, not shown. The contact point 28*b*-l of the switch SW1 is grounded. If the switch SW1 selects its contact point 28*a*-1, its middle fixed point 28*c*-1 is connected to this contact point 28*a*-1 so that driving voltage VDC can be applied across the bias circuit 27. If the switch SW1 selects its contact point 28*b*-1, its middle fixed point 28*c*-1 is connected to this contact point 28*b*-1 so that the bias circuit 17 can be grounded.

The middle fixed point 28*c*-2 of the switch SW2 is connected to the base plate 72. The contact point 28*a*-2 of the switch SW2 is grounded. The contact point 28*b*-2 of the switch SW2 is connected to a driving power supply, not shown. If the switch SW2 selects its contact point 28*a*-2, its middle fixed point 28*c*-2 is connected to this contact point

28*a*-2 so that the parasitic antenna elements 21, 23 can be grounded through the base plate 72. If the switch SW2 selects its contact point 28*b*-2, its middle fixed point 28*c*-2 is connected to this contact point 28*b*-2 so that driving voltage VDC can be applied across the parasitic antenna elements 21, 23 through the base plate 72.

Figure 9:
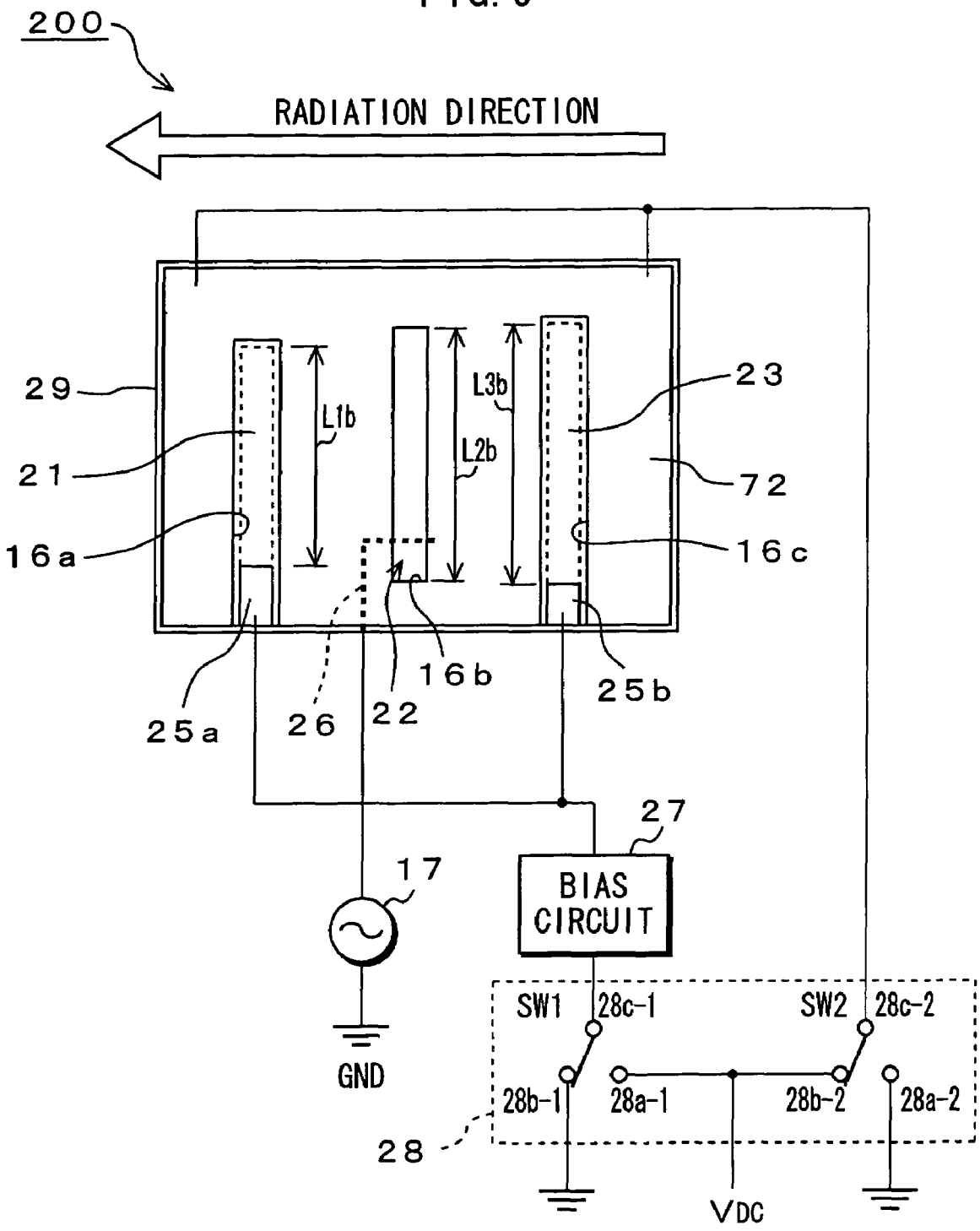
FIG. 9 is a diagram for showing an operational example (as a directional antenna) of the Yagi antenna device as shown in FIG. 8.

FIG. 9 shows an operational example (as a directional antenna) of the Yagi antenna device 200. In this case, the Yagi antenna device 200 has the two line parasitic antenna elements 21, 23 having different lengths (L1*b*, L3*b*) on the dielectric substrate 29, which are positioned on both sides of the dielectric substrate 29 and exposed by the parasitic antenna slots 16*a*, 16*c* of the base plate 72, and the excited antenna slot 16*b* having the length L2*b* (L1*b*<L2*b*<L3*b*), which is arranged on a middle of the base plate 72 with the excited antenna slot 16*b* being away from each of the parasitic antenna slots 16*a*, 16*c* by predetermined distances. In the Yagi antenna device 200, the signal source 8 feeds a transmission signal into the excited antenna slot 16*b*. Forward direct-current biased voltage is applied across each of the control electrodes 25*a*, 25*b* connected with the parasitic antenna elements 21, 23 in the parasitic antenna slots 16*a*, 16*c*.

Under such the situation, in order to allow the Yagi antenna device 200 to have directivity thereof, a control system, not shown, supplies the switch circuit 28 with the switch control data D21 that enables the Yagi antenna device 200 to have directivity thereof. For example, contents of the switch control data D21 include selection of both of the contact points 28*b*-1, 28*b*-2 of the switches SW1, SW2.

In the switch circuit 28, when the switch SW1 selects its contact point 28*b*-1, its middle fixed point 28*c*-1 is connected to this contact point 28*b*-1 based on the switch control data D21 so that the bias circuit 17 can be grounded. At the same time, the switch SW2 selects its contact point 28*b*-2 so that its middle fixed point 28*c*-2 can be connected to this contact point 28*b*-2. The driving voltage VDC can be applied across the dielectric substrate 29 through the base plate 72.

As a result thereof, the reverse direct-current biased voltage VDC is applied across the control electrode 25*a* connected with the parasitic antenna element 21 in the parasitic antenna slot 16*a* and the base plate 72 on the dielectric substrate 29. The reverse direct-current biased voltage VDC is also applied across the control electrode 25*b* connected with the parasitic antenna element 23 in the parasitic antenna slot 16*c* and the base plate 72 on the dielectric substrate 29.

When such the reverse direct-current biased voltage VDC is supplied to the control electrodes 25*a*, 25*b* through the bias circuit 27, anion (electron) is moved from the antenna elements 21, 23 made of the semi-conductive plastic parasitic material to the dielectric substrate 29, thereby enabling both of the semi-conductive plastic antenna elements 21, 23 to be made insulated. This enables insulation to be filled in each of the parasitic antenna slots 16*a*, 16*c*, thereby equaling a cause of virtual slots.

In this Yagi antenna device 200, the parasitic antenna slot 16*a* thus acts as a waveguide and the parasitic antenna slot 16*c* acts as a reflector. Thus, the parasitic antenna slots 16*a*, 16*c* contribute to a radiation by the Yagi antenna device 200. The Yagi antenna device 200 can have directivity like a radiation direction as an arrow shown in FIG. 9.

Figure 10:
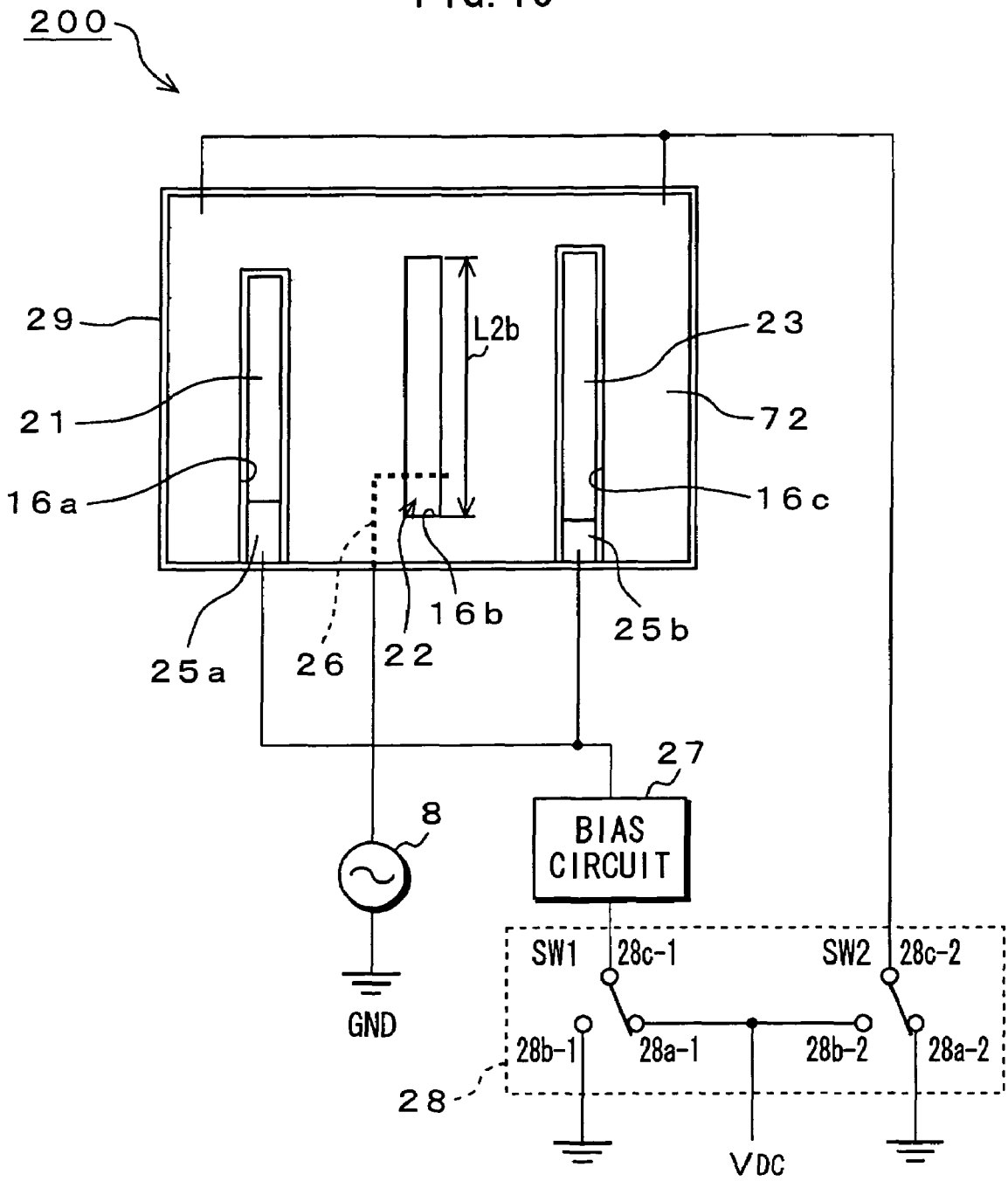
FIG. 10 is a diagram for showing an operational example (as an omnidirectional antenna) of the Yagi antenna device as shown in FIG. 8 as slot type.

FIG. 10 shows an operational example (as an omnidirectional antenna) of the Yagi antenna device 200. In this case, in the Yagi antenna device 200, the signal source 8 feeds a transmission signal into the excited antenna slot 16*b*. Forward direct-current biased voltage is applied across each of the control electrodes 25*a*, 25*b* connected with the parasitic antenna elements 21, 23 in the parasitic antenna slots 16*a*, 16*c*. If, as shown in FIG. 5A, the forward direct-current biased voltage moves anion (electron) from the dielectric substrate 29 to the antenna elements 21, 23, both of the semi-conductive plastic antenna elements 21, 23 can be made conductive. In this moment, the antenna elements 21, 23 are considered to be configured as parts of the base plate 72 so that they do not contribute a radiation by the Yagi antenna device 200. Thus, only the middle excited antenna slot 16*b* is actuated so that the Yagi antenna device 200 can have an omnidirectivity.

Under such the situation, in order to allow the Yagi antenna device 200 to have the omnidirectivity, a control system, not shown, supplies the switch circuit 28 with the switch control data D21 that enables the Yagi antenna device 200 to have the omnidirectivity. For example, contents of the switch control data D21 include selection of both of the contact points 28*a*-1, 28*a*-2 of the switches SW1, SW2.

In the switch circuit 28, when the switch SW1 selects its contact point 28*a*-1, its middle fixed point 28*c*-1 is connected to this contact point 28*a*-1 based on the switch control data D21 so that the driving voltage VDC can be applied across the bias circuit 27. At the same time, the switch SW2 selects its contact point 28*a*-2 so that its middle fixed point 28*c*-2 can be connected to this contact point 28*a*-2. The dielectric substrate 29 can be grounded through the base plate 72.

As a result thereof, the forward direct-current biased voltage VDC is applied across the control electrode 25*a* connected with the parasitic antenna element 21 in the parasitic antenna slot 16*a* and the base plate 72 on the dielectric substrate 29. The forward direct-current biased voltage VDC is also applied across the control electrode 25*b* connected with the parasitic antenna element 23 in the parasitic antenna slot 16*c* and the base plate 72 on the dielectric substrate 29.

When the bias circuit 27 supplies the control electrodes 25*a*, 25*b* with such the forward direct-current biased voltage VDC, anion (electron) is moved from the dielectric substrate 29 made of solid electrolyte material to the antenna elements 21, 23 made of the semi-conductive plastic parasitic material, thereby enabling both of the antenna elements 21, 23 to be made conductive. This enables conductive material to be filled in each of the parasitic antenna slots 16*a*, 16*c*, thereby equaling no cause of virtual slots.

In this Yagi antenna device 200, the parasitic antenna slot 16*a* is prevented from acting as a waveguide and the parasitic antenna slot 16*c* is also prevented from acting as a reflector. Thus, the parasitic antenna slots 16*a*, 16*c* do not contribute to a radiation by the Yagi antenna device 200. The Yagi antenna device 200 can have the omnidirectivity.

Thus, according to the Yagi antenna device 200 as the second embodiment of the invention, the conductive antenna pattern, namely, the conductive base plate 72 on the dielectric substrate 29 has two parasitic antenna slots 16*a*, 16*b* that expose two semi-conductive parasitic antenna elements 21, 23, and one excited antenna slot 16*b* acting as the excited antenna element 22, which is arranged with it being positioned between the two parasitic antenna slots 16*a*, 16*c* with a predetermined distance. The excited antenna slot 16*b* is fed. Forward or reverse biased voltage is applied across each of the control electrodes 25*a*, 25*b* connected with the parasitic antenna elements 21, 23 in the parasitic antenna slots 16*a*, 16*c*.

In this embodiment, when making the parasitic antenna elements 21, 23 conductive, the forward direct-current biased voltage moves any ions from the dielectric substrate 29 to the parasitic antenna elements 21, 23 in the parasitic antenna slots 16*a*, 16*c*. When making the parasitic antenna elements 21, 23 insulated, the reverse direct-current biased voltage moves any ions from the parasitic antenna elements 21, 23 to the dielectric substrate 29.

Thus, when combining antenna elements that are formed by the two parasitic antenna elements 21, 23 made insulated according to this embodiment, it is possible to configure a directional antenna including a wave guide and a reflector. When making conductive the two parasitic antenna elements 21, 23 as the waveguide and the reflector and remaining only the excited antenna slot 16*b* in this directional antenna, it is possible to configure an omnidirectional antenna. This enables the Yagi antenna device 200 to be controlled so that its directivity/omnidirectivity can be adjusted to desired one without making the Yagi antenna device 200 large-scaled and/or expensive. Further, in the wireless LAN, it is possible to use the omnidirectional antenna thereof when performing a carrier sense and to use the directional antenna thereof when performing any communication, without increasing numbers of the antennas to be set.

Figure 11:
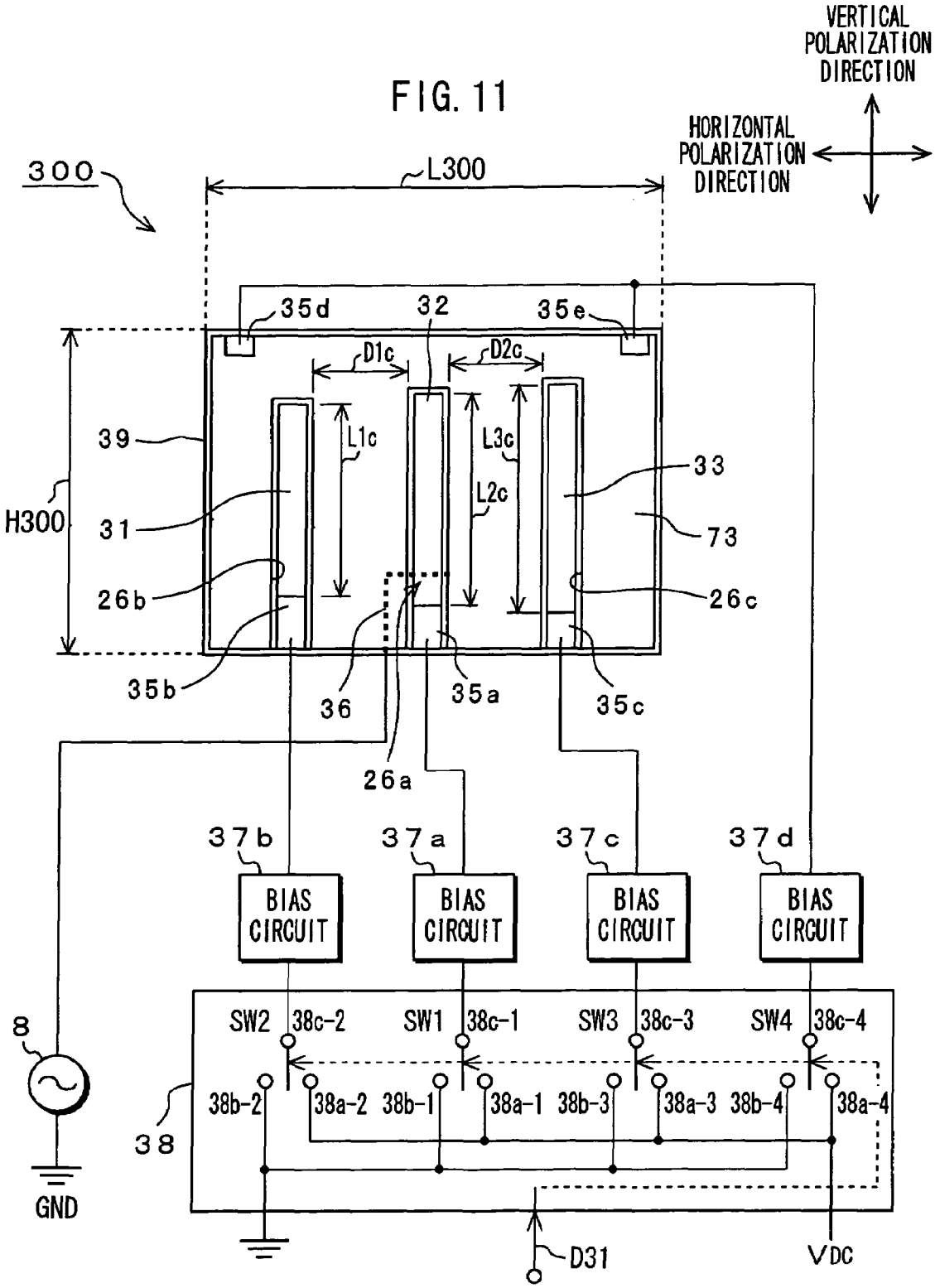
FIG. 11 is a diagram for illustrating a configuration of an antenna device with a polarization switch function according to a third embodiment of the invention.

FIG. 11 illustrates a configuration of an antenna device 300 with a polarization switch function according to a third embodiment of the invention.

In this embodiment, the antenna device 300 has the polarization switch function in addition to the switch function of directivity/omnidirectivity by the Yagi antennas of monopole type described as the first embodiment of the invention and the slot type described as the second embodiment of the invention. In this embodiment, the antenna device 300 has a semi-conductive antenna pattern (hereinafter, referred to as "a base plate 73") on a dielectric substrate 39. The base plate 73 made of semi-conductive plastic material has two slots (hereinafter, referred to as "parasitic antenna slots 26*b*, 26*c*") that respectively expose two parasitic antenna elements 31, 33 made of semi-conductive plastic material, and one slot (hereinafter, referred to as "an excited antenna slot 26*a*") that exposes an excited antenna element 32 made of semi-conductive plastic material, which is arranged with it being positioned between the two parasitic antenna slots 26*b*, 26*c* with predetermined distances D1*c*, D2*c*.

The excited antenna slot 26*a* positioned at a middle of the base plate 73 is fed. Forward or reverse biased voltage is applied across each of the control electrodes 35*b*, 35*c* connected with the parasitic antenna element 31, 33 in the parasitic antenna slots 26*b*, 26*c*, the control electrode 35*a* connected with the excited antenna element 32 in the excited antenna slot 26*a*, and control electrodes 35*d*, 35*e* of the base plate 73. These parasitic antenna elements 31, 33, excited antenna element 32, and base plate 73, which are made of the semi-conductive plastic material and are divided into four, are switched between their conductive state and their insulated state, thereby controlling the radiation of the antenna device 300 to adjust its directivity/omnidirectivity and polarization to desired one.

The antenna device 300 has the base plate 73 that is patterned by the semi-conductive plastic material as the antenna pattern. The base plate 73 has a rectangular shape which covers the whole dielectric substrate 39. For example, the base plate 73 has the excited antenna slot 26*a* for acting as the excited antenna element 32 at a middle position thereof and the parasitic antenna slots 26*b*, 26*c* for exposing the parasitic antenna elements 31, 33 at both sides thereof. As the base plate 73, polyacetylene, polythiophene, polyaniline, polypyrrol, polyazulene and the like are used.

Behind the base plate 73, the dielectric substrate 39 is positioned. The dielectric substrate 39 has, for example, a height of H300 and a length of L300. Similar to the first and second embodiments of the invention, the dielectric substrate 39 is made of solid electrolyte material selected from silicon gel, acrylonitrile gel, polysaccharide polymer and the like, which are used for a lithium ion battery or the like. The solid electrolyte material is subject to anion movement.

On the dielectric substrate 39, antenna bodies having different lengths are provided in addition to the base plate 73. The antenna bodies include the parasitic antenna element 31 for a waveguide, which has a predetermined length L1*c*, the excited antenna element 32 for a feeder which has a length L2*c*, and the parasitic antenna element 33 for a reflector, which has a length L3*c*. These antenna elements 31, 32, 33 are arranged and patterned on the dielectric substrate 39 in order. For example, the parasitic antenna element 31 is positioned in the parasitic antenna slots 26*b*, the excited antenna element 32 is positioned in the excited antenna slot 26*a*, and the parasitic antenna element 33 is positioned in the parasitic antenna slots 26*c*.

Each of the antenna elements 31, 32, 33 has a length corresponding to a wavelength of a frequency within any one of a millimeter wave band, a micrometer wave band, and an ultra-high frequency (UHF) band. They have a relationship on their lengths indicated by L1*c*<L2*c*<L3*c*. For example, if radio wave having a wavelength of $\lambda$ is radiated from the antenna device 300, the length L2*c* of the excited antenna element 32 is a half wavelength long.

The parasitic antenna slot 26*b* is away from the excited antenna slot 26*a* by a distance D1*c*, for example, a quarter wavelength long. Similarly, the parasitic antenna slot 26*c* is also away from the excited antenna slot 26*a* by a distance D2*c*, for example, a quarter wavelength long. The parasitic antenna elements 31, 33, the excited antenna element 32, and the base plate 73 constitute antenna bodies and are respectively made of semi-conductive plastic material. Such the semi-conductive plastic material has been described in the first embodiment.

In this embodiment, if direct-current biased voltage that has a desired direction is applied across a layer of the semi-conductive plastic material and a layer of the solid electrolyte material, ion can be moved according to a direction of the applied voltage. This enables the semi-conductive plastic material to be made conductive or insulated. This embodiment of the invention utilizes such the behavior of the semi-conductive plastic material to switch the complex antenna bodies between the line parasitic antenna elements 31 through 33 and the parasitic antenna slots 26*a* through 26*c*.

The parasitic antenna slots 26*a*, 26*b*, 26*c* open at a side of the dielectric substrate 39. The control electrode 35*a* is connected with an end of the excited antenna element 32 and is positioned at an exit of the parasitic antenna slot 26*a*. The control electrode 35*b* is connected with an end of the parasitic antenna element 31 and is positioned at an exit of the parasitic antenna slot 26*b*. Similarly, the control electrode 35*c* is connected with an end of the parasitic antenna element 33 and is positioned at an exit of the parasitic antenna slot 26*c*. In this embodiment, the base plate 73 is provided with control electrodes 35*d*, 35*e*.

Direct-current biased voltage is applied across each of the control electrodes 35*a* through 35*e*. The direct-current biased voltage is controlled to switch each of the semi-conductive parasitic antenna elements 31, 33, the semi-conductive excited antenna element 32, the semi-conductive base plate 73 between their insulation state and their conductive state.

The excited antenna element 32 is connected to a signal source 8 via a feeding line (micro strip line) 36 extending from the excited antenna element 32 to an end of the signal source 8. A part of the feeding line 36 extends in a direction orthogonal to a longitudinal direction of the parasitic antenna slot 26*a* on the rear surface of the dielectric substrate 39. The signal source 8 feeds a transmission signal to the excited antenna element 32 through the feeding line 36. The other end of the signal source 8 is grounded.

The control electrodes 35*a* through 35*c* are respectively connected to bias circuits 37*a* through 37*c* through the exits of the excited and parasitic antenna slots 26*a* through 26*c* via wired lines respectively extending from the control electrodes 35*a* through 35*c* to an end of each of the bias circuits 37*a* through 37*c*. The control electrodes 35*d*, 35*e* are respectively connected to a bias circuit 37*d* via wired lines respectively extending from the control electrodes 35*d*, 35*e* to an end of the bias circuit 37*d*. The bias circuits respectively apply the direct-current biased voltage across each of the control electrodes 35*a* through 35*e* of the parasitic antenna elements 31, 33 and the excited antenna element 32, and the base plate 73.

In this embodiment, the antenna device 300 uses the signal source 8, four bias circuits 37*a* through 37*d*, and a switch circuit 38 with them being combined. The other end of each of the bias circuits 37*a* through 37*d* is connected to the switch circuit 38. The switch circuit 38 has four switches SW1 through SW4. The switch circuit 38 changes over its switches based on switch control data D31. Each of the switches SW1 through SW4 has contact points 38*a*-1, 38*b*-1, 38*a*-2, 38*b*-2, 38*a*-3, 38*b*-3, 38*a*-4, 38*b*-4 and a middle fixed point 38*c*-1, 38*c*-2, 38*c*-3, 38*c*-4.

The middle fixed point 38*c*-1 of the switch SW1 is connected to the bias circuit 37*a*. The contact point 38*a*-1 of the switch SW1 is connected to a driving power supply, not shown. The contact point-38*b*-1 of the switch SW1 is grounded. If the switch SW1 switches on, namely, selects its contact point 38*a*-1, its middle fixed point 38*c*-1 is connected to this contact point 38*a*-1 so that driving voltage VDC can be applied across the bias circuit 37*a*. The bias circuit 37*a* supplies the control electrode 35*a* of the excited antenna element 32 with any forward direct-current biased voltage. If the switch SW1 switches off, namely, selects its contact point 38*b*-1, its middle fixed point 38*c*-1 is connected to this contact point 38*b*-l so that the bias circuit 37*a* can be grounded. The bias circuit 37*a* supplies the control electrode 35*a* of the excited antenna element 32 with any reverse direct-current biased voltage.

The middle fixed point 38*c*-2 of the switch SW2 is connected to the bias circuit 37*b*. The contact point 38*a*-2 of the switch SW2 is connected to the driving power supply, not shown. The contact point 38*b*-2 of the switch SW2 is grounded. If the switch SW2 switches on, namely, selects its contact point 38*a*-2, its middle fixed point 38*c*-2 is connected to this contact point 38*a*-2 so that the driving voltage VDC can be applied across the bias circuit 37*b*. The bias circuit 37*b* supplies the control electrode 35*b* of the parasitic antenna element 31 with any forward direct-current biased voltage. If the switch SW2 switches off, namely, selects its contact point 38*b*-2, is middle fixed point 38*c*-2 is connected to this contact point 38*b*-2 so that the bias circuit 37*b* can be grounded. The bias circuit 37*b* supplies the control electrode 35*b* of the parasitic antenna element 31 with any reverse direct-current biased voltage.

The middle fixed point 38*c*-3 of the switch SW3 is connected to the bias circuit 37*c*. The contact point 38*a*-3 of the switch SW3 is connected to the driving power supply, not shown. The contact point 38*b*-3 of the switch SW3 is grounded. If the switch SW3 switches on, namely, selects its contact point 38*a*-3, its middle fixed point 38*c*-3 is connected to this contact point 38*a*-3 so that the driving voltage VDC can be applied across the bias circuit 37*c*. The bias circuit 37*c* supplies the control electrode 35*c* of the parasitic antenna element 33 with any forward direct-current biased voltage. If the switch SW3 switches off, namely, selects its contact point 38*b*-3, its middle fixed point 38*c*-3 is connected to this contact point 38*b*-3 so that the bias circuit 37*c* can be grounded. The bias circuit 37*c* supplies the control electrode 35*c* of the parasitic antenna element 33 with any reverse direct-current biased voltage.

The middle fixed point 38*c*-4 of the switch SW4 is connected to the bias circuit 37*d*. The contact point 38*a*-4 of the switch SW4 is connected to the driving power supply, not shown. The contact point 38*b*-4 of the switch SW4 is grounded. If the switch SW4 switches on, namely, selects its contact point 38*a*-4, its middle fixed point 38*c*-4 is connected to this contact point 38*a*-4 so that the driving voltage VDC can be applied across the bias circuit 37*d*. The bias circuit 37*d* supplies the control electrodes 35*d*, 35*e* of the base plate 73 with any forward direct-current biased voltage. If the switch SW4 switches off, namely, selects its contact point 38*b*-4, its middle fixed point 38*c*-4 is connected to this contact point 38*b*-4 so that the bias circuit 37*d* can be grounded. The bias circuit 37*d* supplies the control electrodes 35*d*, 35*e* of the base plate 73 with any reverse direct-current biased voltage.

The following will describe operations of the antenna device 300 with a polarization switch function according to the third embodiment of the invention.

According to the antenna device 300 shown in FIG. 11, the parasitic antenna elements 31, 33, the excited antenna element 32, and the base plate 73, which are made of the semiconductive plastic material, are provided and patterned. The switch circuit 38 for switching the switches SW1 through SW4 and the four bias circuits 37*a* through 37*d* are also provided. It is thus possible to achieve four radiation conditions by this antenna device 300 by controlling the switching according to any combinations of the switches SW1 through SW4 as shown in the following TABLE 1.

TABLE 1

| SWITCHES | COMBINATION 1 | COMBINATION 2 | COMBINATION 3 | COMBINATION 4 |
|---|---|---|---|---|
| SW1 | OFF | OFF | ON | ON |
| SW2 | ON | OFF | OFF | ON |
| SW3 | ON | OFF | OFF | ON |
| SW4 | ON | ON | OFF | OFF |
| | ↓ | ↓ | ↓ | ↓ |
| ANTENNA TYPES | SLOT ANTENNA | YAGI ANTENNA OF SLOT TYPE | ZEPPELIN ANTENNA | YAGI ANTENNA OF ZEPPELIN TYPE |
| DIRECTIVITY | OMNIDIRECTIONAL | DIRECTIONAL | OMNIDIRECTIONAL | DIRECTIONAL |
| POLARIZATION | HORIZONTAL POLARIZATION | HORIZONTAL POLARIZATION | VERTICAL POLARIZATION | VERTICAL POLARIZATION |

In TABLE 1, a term, "ON" indicates that any of the switches SW1 through SW4 selects their contact point 38*a*; and a term, "OFF" indicates that any of the switches SW1 through SW4 selects their contact point 38*b*.

According to a combination 1 of the switches, only the switch SW1 switches off and the switches SW2 through SW4 respectively switch on. In this moment, the parasitic antenna elements 31, 33 and the base plate 73 are made conductive but the excited antenna element 32 is made insulated. This equals to form a slot in the base plate 73 so that the excited antenna slot 26*a* can act as the excited antenna element. In other words, this forms a slot antenna. This antenna has an omnidirectivity and a horizontal polarization.

According to a combination 2 of the switches, the switches SW1 through SW3 switch off and only the switch SW4 switches on. In this moment, only the base plate 73 is made conductive but element 32 are respectively made insulated. This equals to form a slot for a waveguide, an excited antenna slot, and a slot for reflector in the base plate 73 so that these slots 26*a*, 26*b*, 26*c* can act as the waveguide, the excited antenna element, and the reflector. In other words, this forms a Yagi antenna of slot type. This antenna has directivity and a horizontal polarization.

According to a combination 3 of the switches, only the switch SW1 switches on and the switches SW2 through SW4 respectively switch off. In this moment, only the excited antenna element 32 is made conductive but the parasitic antenna elements 31, 33 and the base plate 73 are respectively made insulated. This prevents the parasitic antenna slots 26*b*, 26*c* from acting as a waveguide and a reflector. In other words, this forms a Zeppelin antenna. This antenna has an omnidirectivity and a vertical polarization.

According to a combination 4 of the switches, the switches SW1 through SW3 respectively switches on and only the switch SW4 switches off. In this moment, only the base plate 73 is made insulated but the parasitic antenna elements 31, 33 and the excited antenna element 32 are respectively made conductive. This enables the parasitic antenna element 31 for a waveguide, the excited antenna element 32, and the parasitic antenna element 33 for a reflector to be actuated so that these antenna elements 31, 32, 33 can act as the waveguide, the excited antenna element, and the reflector. In other words, this forms a Yagi antenna of Zeppelin type. This antenna has directivity and a vertical polarization.

Thus, according to the antenna device 300 as the third embodiment of the invention, the semi-conductive base plate 73 is provided on the dielectric substrate 39. The base plate 73 made of semi-conductive plastic material has two parasitic antenna slots 26*b*, 26*c* that respectively expose two parasitic antenna elements 31, 33 made of semi-conductive plastic material, and one excited antenna slot 26*a* that exposes the excited antenna element 32 made of semi-conductive plastic material, which is arranged with it being positioned between the two parasitic antenna slots 26*b*, 26*c* with predetermined distances. Forward or reverse biased voltage is applied across each of the control electrodes 35*b*, 35*c* connected with the parasitic antenna element 31, 33 in the parasitic antenna slots 26*b*, 26*c*, the control electrode 35*a* connected with the excited antenna element 32 in the excited antenna slot 26*a*, and the control electrodes 35*d*, 35*e* of the base plate 73.

Thus, the antenna device 300 of this embodiment can control its polarization to adjust its horizontal and vertical polarizations to desired one, in addition to the switch function of directivity/omnidirectivity, which has been described in the first and second embodiments of the invention. This allows an optimal communication condition for the antenna device 300 to be achieved by changing their situations adaptively under a user's environment without making the antenna device 300 large-scaled and/or expensive. Further, in the wireless LAN, it is possible to use the omnidirectional antenna thereof when performing a carrier sense and to use the directional antenna thereof when performing any communication, without increasing numbers of the antennas to be set.

Figure 12:
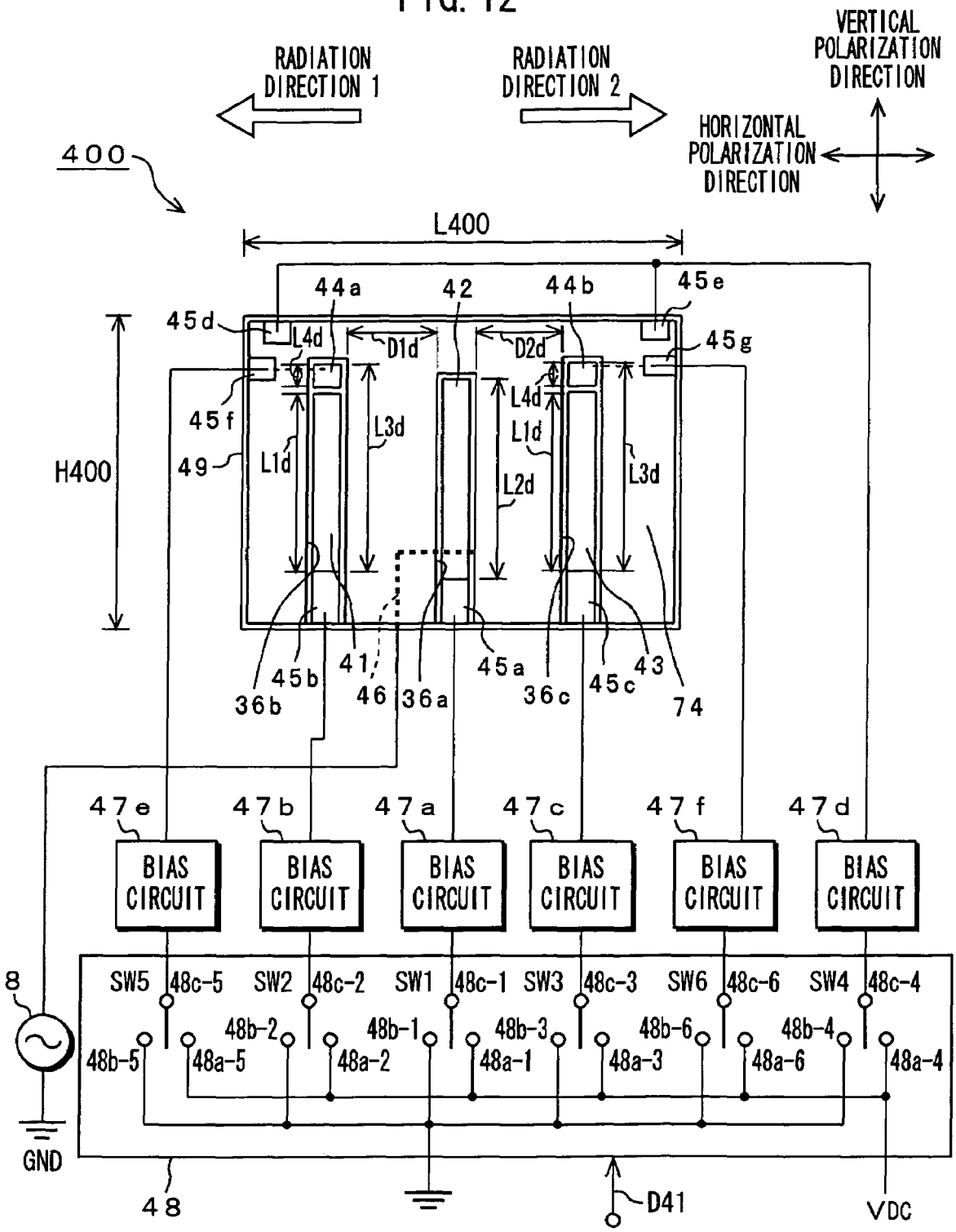
FIG. 12 is a diagram for illustrating a configuration of an antenna device with a radiating direction selection function according to a fourth embodiment of the invention.

FIG. 12 illustrates a configuration of an antenna device 400 with a radiating direction selection function according to a fourth embodiment of the invention.

In this embodiment, in addition to the polarization switch function that has been described in the third embodiment, the antenna device 400 has beam-radiating direction selection function. In this embodiment, the antenna device 400 can select six situations suitably on items of the antenna types, directivity, polarization, and the like. The antenna device 400 can also select a beam-radiating direction when selecting a directional antenna.

The antenna device 400 shown in FIG. 12 has a base plate 74 that is patterned by the semi-conductive plastic material as the antenna pattern. The base plate 74 has a rectangular shape which covers a whole dielectric substrate 49. For example, the base plate 74 has an excited antenna slot 36*a* for exposing an excited antenna element 42 at a middle position thereof and parasitic antenna slots 36*b*, 36*c* for exposing parasitic antenna elements 41, 43 at both sides thereof.

Behind the base plate 74, a dielectric substrate 49 is positioned. The dielectric substrate 49 has, for example, a height of H400 and a length of L400. Similar to the first, second, and third embodiments of the invention, the dielectric substrate 49 is made of solid electrolyte material selected from silicon gel, acrylonitrile gel, polysaccharide polymer and the like, which are used for a lithium ion battery or the like. The solid electrolyte material is subject to anion movement.

On the dielectric substrate 49, antenna bodies having different lengths are provided in addition to the base plate 74. The antenna bodies include the parasitic antenna elements 41, 43 each having a predetermined length L1*d*, the excited antenna element 42 for a feeder which has a length L2*d*, and length-adjustment elements 44*a*, 44*b* each having a length L4*d*. These antenna elements 41, 42, 43 and the length-adjustment elements 44*a*, 44*b* are arranged and patterned on the dielectric substrate 49 at the predetermined positions thereof.

For example, the excited antenna element 42 is positioned in the excited antenna slot 36*a*. The excited antenna element 42 has a length corresponding to a wavelength of a frequency within any one of a millimeter wave band, a micrometer wave band, and an ultra-high frequency (UHF) band. The parasitic antenna element 41 and the length-adjustment element 44*a* are positioned in the parasitic antenna slot 36*b* in order on a longitudinal direction thereof. Because the parasitic antenna element 41 has the length L1*d* and the length-adjustment element 44*a* has the length L4*d*, the parasitic antenna element 41 and the length-adjustment element 44*a* act as a reflector having a length L3*d*=L1*d*+L4*d* when the parasitic antenna element 41 and the length-adjustment element 44*a* are made conductive. The parasitic antenna element 41 acts as a waveguide having a length L1*d* when the parasitic antenna element 41 is made conductive but the length-adjustment element 44*a* is made insulated.

The parasitic antenna element 43 and the length-adjustment element 44*b* are positioned in the parasitic antenna slot 36*c* in order on a longitudinal direction thereof. Because the parasitic antenna element 43 has the length L1*d* and the length-adjustment element 44*b* has the length L4*d*, the parasitic antenna element 43 and the length-adjustment element 44*b* act as a reflector having a length L3*d*=L1*d*+L4*d* when the parasitic antenna element 43 and the length-adjustment element 44*b* are made conductive. The parasitic antenna element 43 acts as a waveguide having a length L1*d* when the parasitic antenna element 43 is made conductive but the length-adjustment element 44*b* is made insulated.

The antenna elements 41, 42, 43 and the like have a relationship on their lengths indicated by L1*d*<L2*d*<L3*d*. For example, if radio wave having a wavelength of λ is radiated from the antenna device 400, the length L2*d* of the excited antenna element 42 is a half wavelength long.

The parasitic antenna slot 36*b* is away from the excited antenna slot 36*a* by a distance D1*d*, for example, a quarter wavelength long. Similarly, the parasitic antenna slot 36*c* is also away from the excited antenna slot 36*a* by a distance D2*d*, for example, a quarter wavelength long.

The parasitic antenna elements 41, 43, the excited antenna element 42, and the length-adjustment elements 44*a*, 44*b* constitute the antenna bodies and are respectively made of semi-conductive plastic material like the base plate 74. As the semi-conductive plastic material, polyacetylene, polythiophene, polyaniline, polypyrrol, polyazulene and the like are used, which have been described in the first embodiment. The parasitic antenna elements 41, 43, the excited antenna element 42, the length-adjustment elements 44*a*, 44*b*, and the base plate 74, which are divided in six, are respectively switched between their conductive state and their insulation state, thereby controlling directivity/omnidirectivity and polarization of radiation by the antenna device 400.

In this embodiment, if direct-current biased voltage that has a desired direction is applied across a layer of the semi-conductive plastic material and a layer of the solid electrolyte material, ion can be moved according to a direction of the applied voltage. This enables the semi-conductive plastic material to be made conductive or insulated. This embodiment of the invention utilizes such the behavior of the semi-conductive plastic material to switch the antenna functions by the line parasitic antenna elements 41, 43 and the parasitic antenna slots 36*b*, 36*c*.

The parasitic antenna slots 36*a*, 36*b*, 36*c* open at a side of the dielectric substrate 49. The control electrode 45*a* is connected with an end of the excited antenna element 42 and is positioned at an exit of the parasitic antenna slot 36*a*. The control electrode 45*b* is connected with an end of the parasitic antenna element 41 and is positioned at an exit of the parasitic antenna slot 36*b*. Similarly, the control electrode 45*c* is connected with an end of the parasitic antenna element 43 and is positioned at an exit of the parasitic antenna slot 36*c*. In this embodiment, the base plate 74 is provided with control electrodes 45*d*, 45*e*. A control electrode 45*f* is connected to the length-adjustment element 44*a* and a control electrode 45*g* is connected to the length-adjustment element 44*b*.

Direct-current biased voltage is applied across each of the control electrodes 45*a* through 45g. The direct-current biased voltage is controlled to switch each of the semi-conductive parasitic antenna elements 41, 43, the semi-conductive excited antenna element 42, the semi-conductive length-adjustment elements 44*a*, 44*b*, the semi-conductive base plate 74 between their insulation state and their conductive state. Such the switch enables to be controlled directivity/omnidirectivity and radiated polarization and radiation direction of radio wave by the antenna device 400.

The excited antenna element 42 is connected to a signal source 8 via a feeding line (micro strip line) 46 extending from the excited antenna element 42 to an end of the signal source 8. A part of the feeding line 46 extends in a direction orthogonal to a longitudinal direction of the parasitic antenna slot 36*a* on the rear surface of the dielectric substrate 49. The signal source 8 feeds a transmission signal to the excited antenna element 42 through the feeding line 46. The other end of the signal source 8 is grounded.

The control electrode 45*a* is connected to a bias circuit 47*a* via wired line extending from the control electrode 45*a* to an end of the bias circuit 47*a* through the exit of the excited antenna slot 36*a*. Similarly, the control electrode 45*b* is connected to a bias circuit 47*b* via wired line extending from the control electrode 45*b* to an end of the bias circuit 47*b* through the exit of the parasitic antenna slot 36*b*. Further, the control electrode 45*c* is connected to a bias circuit 47*c* via wired line extending from the control electrode 45*c* to an end of the bias circuit 47*c* through the exit of the parasitic antenna slot 36*c*.

The control electrodes 45*d*, 45*e* are respectively connected to a bias circuit 47*d* via wired lines respectively extending from the control electrodes 45*d*, 45*e* to an end of the bias circuit 47*d*. The control electrode 45*f* is connected to the bias circuit 47*e* via wired line extending from the control electrode 45*f* to an end of the bias circuit 47*e*. The control electrode 45*g* is connected to the bias circuit 47*f* via wired line extending from the control electrode 45*g* to an end of the bias circuit 47*f*. The bias circuits respectively apply the direct-current biased voltage across each of the control electrodes 45*a* through 45*g* of the parasitic antenna elements 41, 43, the excited antenna element 42, and the length-adjustment elements 44*a*, 44*b* and the base plate 74.

In this embodiment, the antenna device 400 uses the signal source 8, six bias circuits 47*a* through 47*f*, and a switch circuit 48 with them being combined. The other end of each of the bias circuits 47*a* through 47*f* is connected to the switch circuit 48. The switch circuit 48 has six switches SW1 through SW6. The switch circuit 48 changes over its switches based on switch control data D41. The switches SW1 through SW6 have contact points 48*a*-1, 48*b*-1, 48*a*-2, 48*b*-2, 48*a*-3, 48*b*-3, 48*a*-4, 48*b*-4, 48*a*-5, 48*b*-5, 48*a*-6, 48*b*-6 and a middle fixed point 48*c*-1, 48*c*-2, 48*c*-3, 48*c*-4, 48*c*-5, 48*c*-6.

The middle fixed point 48*c*-1 of the switch SW1 is connected to the bias circuit 47*a*. The contact point 48*a*-1 of the switch SW1 is connected to a driving power supply, not shown. The contact point 48*b*-1 of the switch SW1 is grounded. If the switch SW1 switches on, namely, selects its contact point 48*a*-1, its middle fixed point 48*c*-1 is connected to this contact point 48*a*-1 so that driving voltage VDC can be applied across the bias circuit 47*a*. The bias circuit 47*a* supplies the control electrode 45*a* of the excited antenna element 42 with any forward direct-current biased voltage. If the switch SW1 switches off, namely, selects its contact point 48*b*-1, its middle fixed point 48*c*-1 is connected to this contact point 48*b*-1 so that the bias circuit 47*a* can be grounded. The bias circuit 47*a* supplies the control electrode 45*a* of the excited antenna element 42 with any reverse direct-current biased voltage.

The middle fixed point 48*c*-2 of the switch SW2 is connected to the bias circuit 47*b*. The contact point 48*a*-2 of the switch SW2 is connected to the driving power supply, not shown. The contact point 48*b*-2 of the switch SW2 is grounded. If the switch SW2 switches on, namely, selects its contact point 48*a*-2, its middle fixed point 48*c*-2 is connected to this contact point 48*a*-2 so that the driving voltage VDC can be applied across the bias circuit 47*b*. The bias circuit 47*b* supplies the control electrode 45*b* of the parasitic antenna element 41 with any forward direct-current biased voltage. If the switch SW2 switches off, namely, selects its contact point 48*b*-2, its middle fixed point 48*c*-2 is connected to this contact point 48*b*-2 so that the bias circuit 47*b* can be grounded. The bias circuit 47*b* supplies the control electrode 45*b* of the parasitic antenna element 41 with any reverse direct-current biased voltage.

The middle fixed point 48*c*-3 of the switch SW3 is connected to the bias circuit 47*c*. The contact point 48*a*-3 of the switch SW3 is connected to the driving power supply, not shown. The contact point 48*b*-3 of the switch SW3 is grounded. If the switch SW3 switches on, namely, selects its contact point 48*a*-3, its middle fixed point 48*c*-3 is connected to this contact point 48*a*-3 so that the driving voltage VDC can be applied across the bias circuit 47*c*. The bias circuit 47*c* supplies the control electrode 45*c* of the parasitic antenna element 43 with any forward direct-current biased voltage. If the switch SW3 switches off, namely, selects its contact point 48*b*-3, its middle fixed point 48*c*-3 is connected to this contact point 48*b*-3 so that the bias circuit 47*c* can be grounded. The bias circuit 47*c* supplies the control electrode 45*c* of the parasitic antenna element 43 with any reverse direct-current biased voltage.

The middle fixed point 48*c*-4 of the switch SW4 is connected to the bias circuit 47*d*. The contact point 48*a*-4 of the switch SW4 is connected to the driving power supply, not shown. The contact point 48*b*-4 of the switch SW4 is grounded. If the switch SW4 switches on, namely, selects its contact point 48*a*-4, its middle fixed point 48*c*-4 is connected to this contact point 48*a*-4 so that the driving voltage VDC can be applied across the bias circuit 47*d*. The bias circuit 47*d* supplies the control electrodes 45*d*, 45*e* of the base plate 74 with any forward direct-current biased voltage. If the switch SW4 switches off, namely, selects its contact point 48*b*-4, its middle fixed point 48*c*-4 is connected to this contact point 48*b*-4 so that the bias circuit 47*d* can be grounded. The bias circuit 47*d* supplies the control electrodes 45*d*, 45*e* of the base plate 74 with any reverse direct-current biased voltage.

The middle fixed point 48*c*-5 of the switch SW5 is connected to the bias circuit 47*e*. The contact point 48*a*-5 of the switch SW5 is connected to the driving power supply, not shown. The contact point 48*b*-5 of the switch SW5 is grounded. If the switch SW5 switches on, namely, selects its contact point 48*a*-5, its middle fixed point 48*c*-5 is connected to this contact point 48*a*-5 so that the driving voltage VDC can be applied across the bias circuit 47*e*. The bias circuit 47*e* supplies the control electrode 45*f* of the length-adjustment element 44*a* with any forward direct-current biased voltage. If the switch SW5 switches off, namely, selects its contact point 48*b*-5, its middle fixed point 48*c*-5 is connected to this contact point 48*b*-5 so that the bias circuit 47*e* can be grounded. The bias circuit 47*e* supplies the control electrode 45*f* of the length-adjustment element 44*a* with any reverse direct-current biased voltage.

The middle fixed point 48*c*-6 of the switch SW6 is connected to the bias circuit 47*f*. The contact point 48*a*-6 of the switch SW6 is connected to the driving power supply, not shown. The contact point 48*b*-6 of the switch SW6 is grounded. If the switch SW6 switches on, namely, selects its contact point 48*a*-6, its middle fixed point 48*c*-6 is connected to this contact point 48*a*-6 so that the driving voltage VDC can be applied across the bias circuit 47*f*. The bias circuit 47*f* supplies the control electrode 45*g* of the length-adjustment element 44*b* with any forward direct-current biased voltage. If the switch SW6 switches off, namely, selects its contact point 48*b*-6, its middle fixed point 48*c*-6 is connected to this contact point 48*b*-6 so that the bias circuit 47*f* can be grounded. The bias circuit 47*f* supplies the control electrode 45*g* of the length-adjustment element 44*b* with any reverse direct-current biased voltage.

The following will describe operations of the antenna device 400 with a radiating direction selection function according to the fourth embodiment of the invention.

According to the antenna device 400 shown in FIG. 12, the parasitic antenna elements 41, 43, the excited antenna element 42, the base plate 74, and the length-adjustment elements 44*a*, 44*b*, which are made of the semi-conductive plastic material, are provided and patterned. The switch circuit 48 for switching the switches SW1 through SW6 and six bias circuits 47*a* through 47*f* are also provided. It is thus possible to achieve six radiation conditions by this antenna device 400 by controlling the switch setting according to any combinations of the switches SW1 through SW6 as shown in the following TABLE 2.

TABLE 2

| SWITCHES | COMBINATION 1 | COMBINATION 2 | COMBINATION 3 | COMBINATION 4 | COMBINATION 5 | COMBINATION 6 |
|---|---|---|---|---|---|---|
| SW1 | OFF | OFF | OFF | ON | ON | ON |
| SW2 | ON | OFF | OFF | OFF | ON | ON |
| SW3 | ON | OFF | OFF | OFF | ON | ON |
| SW4 | ON | ON | ON | OFF | OFF | OFF |
| SW5 | ON | ON | OFF | OFF | OFF | ON |
| SW6 | ON | OFF | ON | OFF | ON | OFF |
| | ↓ | ↓ | ↓ | ↓ | ↓ | ↓ |
| ANTENNA TYPES | SLOT ANTENNA | YAGI ANTENNA OF SLOT TYPE | | ZEPPELIN ANTENNA | YAGI ANTENNA OF ZEPPELIN TYPE | |
| DIRECTIVITY | OMNI-DIRECTIONAL | DIRECTIONAL | DIRECTIONAL | OMNI-DIRECTIONAL | DIRECTIONAL | DIRECTIONAL |
| POLARIZATION | HORIZONTAL POLARIZATION | HORIZONTAL POLARIZATION | HORIZONTAL POLARIZATION | VERTICAL POLARIZATION | VERTICAL POLARIZATION | VERTICAL POLARIZATION |
| RADIATION | | RADIATION DIRECTION 1 | RADIATION DIRECTION 2 | | RADIATION DIRECTION 1 | RADIATION DIRECTION 2 |

In TABLE 2, a term, "ON" indicates that any of the switches SW1 through SW6 selects their contact point 48*a*; and a term, "OFF" indicates that any of the switches SW1 through SW6 selects their contact point 48*b*.

According to a combination 1 of the switches, only the switch SW1 switches off and the switches SW2 through SW6 respectively switch on. In this moment, the parasitic antenna elements 41, 43, the length-adjustment elements 44*a*, 44*b*, and the base plate 74 are made conductive but the excited antenna element 42 is made insulated. This equals to form a slot in the base plate 74 so that the excited antenna slot 36*a* can act as the excited antenna element. In other words, this forms a slot antenna. This antenna has an omnidirectivity and a horizontal polarization.

According to a combination 2 of the switches, the switches SW1 through SW3 and SW6 switch off and the switches SW4, SW5 switches on. In this moment, the length-adjustment element 44*a* and the base plate 74 are made conductive but the parasitic antenna elements 41, 43, the length-adjustment element 44*b*, and the excited antenna element 42 are respectively made insulated. This equals to form a slot for a waveguide, an excited antenna slot, and a slot for reflector in the base plate 74. In other words, this forms a Yagi antenna of slot type. This antenna has directivity, a horizontal polarization and a radiation direction 1 as shown in FIG. 12.

According to a combination 3 of the switches, the switches SW4, SW6 switch on and the switches SW1 through SW3, SW5 respectively switch off. In this moment, the length-adjustment element 44*b* and the base plate 74 are made conductive but the parasitic antenna elements 41, 43, the length-adjustment element 44*a*, and the excited antenna element 42 are respectively made insulated. This equals to form a slot for a waveguide, an excited antenna slot, and a slot for reflector in the base plate 74. In other words, this forms a Yagi antenna of slot type. This antenna has directivity, a horizontal polarization and a radiation direction 2 as shown in FIG. 12.

According to a combination 4 of the switches, only the switch SW1 switches on and the switches SW2 through SW6 respectively switch off. In this moment, only the excited antenna element 42 is made conductive but the parasitic antenna elements 41, 43, the length-adjustment elements 44*a*, 44*b*, and the base plate 74 are respectively made insulated. Namely, only the excited antenna element 42 can be actuated. This equals to prevent a waveguide, a feeder, and a reflector from being actuated. As a result thereof, this forms a Zeppelin antenna. This antenna has an omnidirectivity and a vertical polarization.

According to a combination 5 of the switches, the switches SW1 through SW3, SW6 respectively switches on and the switches SW4, SW5 switch off. In this moment, the base plate 74 and the length-adjustment element 44*a* are made insulated but the parasitic antenna elements 41, 43, the excited antenna element 42, and the length-adjustment element 44*b* are respectively made conductive. This equals to form a waveguide, a feeder, and a reflector in the base plate 74. In other words, this forms a Yagi antenna of Zeppelin type. This antenna has directivity, a vertical polarization, and a radiation direction 1 shown in FIG. 12.

According to a combination 6 of the switches, the switches SW1 through SW3, SW5 respectively switches on and the switches SW4, SW6 switch off. In this moment, the base plate 74 and the length-adjustment element 44*b* are made insulated but the parasitic antenna elements 41, 43, the excited antenna element 42, and the length-adjustment element 44*a* are respectively made conductive. This equals to form a waveguide, a feeder, and a reflector in the base plate 74. In other words, this forms a Yagi antenna of Zeppelin type. This antenna has directivity, a vertical polarization, and a radiation direction 2 shown in FIG. 12.

Thus, according to the antenna device 400 as the fourth embodiment of the invention, the semi-conductive base plate 74 is provided on the dielectric substrate 49. The base plate 74 made of semi-conductive plastic material has two parasitic antenna slots 36*b*, 36*c* that respectively expose two parasitic antenna elements 41, 43 made of semi-conductive plastic material and the length-adjustment elements 44*a*, 44*b* made of semi-conductive plastic material, and one excited antenna slot 36*a* that exposes the excited antenna element 42 made of semi-conductive plastic material, which is arranged with it being positioned between the two parasitic antenna slots 36*b*, 36*c* with predetermined distances. Forward or reverse biased voltage is applied across each of the control electrodes 45*b*, 45*c* connected with the parasitic antenna element 41, 43 in the parasitic antenna slots 36*b*, 36*c*, the control electrode 45*a* connected with the excited antenna element 42 in the excited antenna slot 36*a*, the control electrodes 45*d*, 45*e* of the base plate 74, and the control electrodes 45*f*, 45*g* of the length-adjustment elements, 44*a*, 44*b*.

Thus, the antenna device 400 of this embodiment can adjust its beam-radiating direction to desired one, in addition to the switch function of directivity/omnidirectivity, which has been described in the first and second embodiments of the invention, and the polarization switch function, which has been described in the third embodiment of the invention. This allows an optimal communication condition for the antenna device 400 to be achieved by changing their situations adaptively under a user's environment without making the antenna device 400 large-scaled and/or expensive. Further, in the wireless LAN, it is possible to use the omnidirectional antenna thereof when performing a carrier sense and to use the directional antenna thereof when performing any communication, without increasing numbers of the antennas to be set.

Since plastic material is used in the above antenna devices 100, 200, 300, 400, it can reduce a weight of antenna device, thereby causing a weight of the wireless communication apparatus using them to be reduced.

Figure 13:
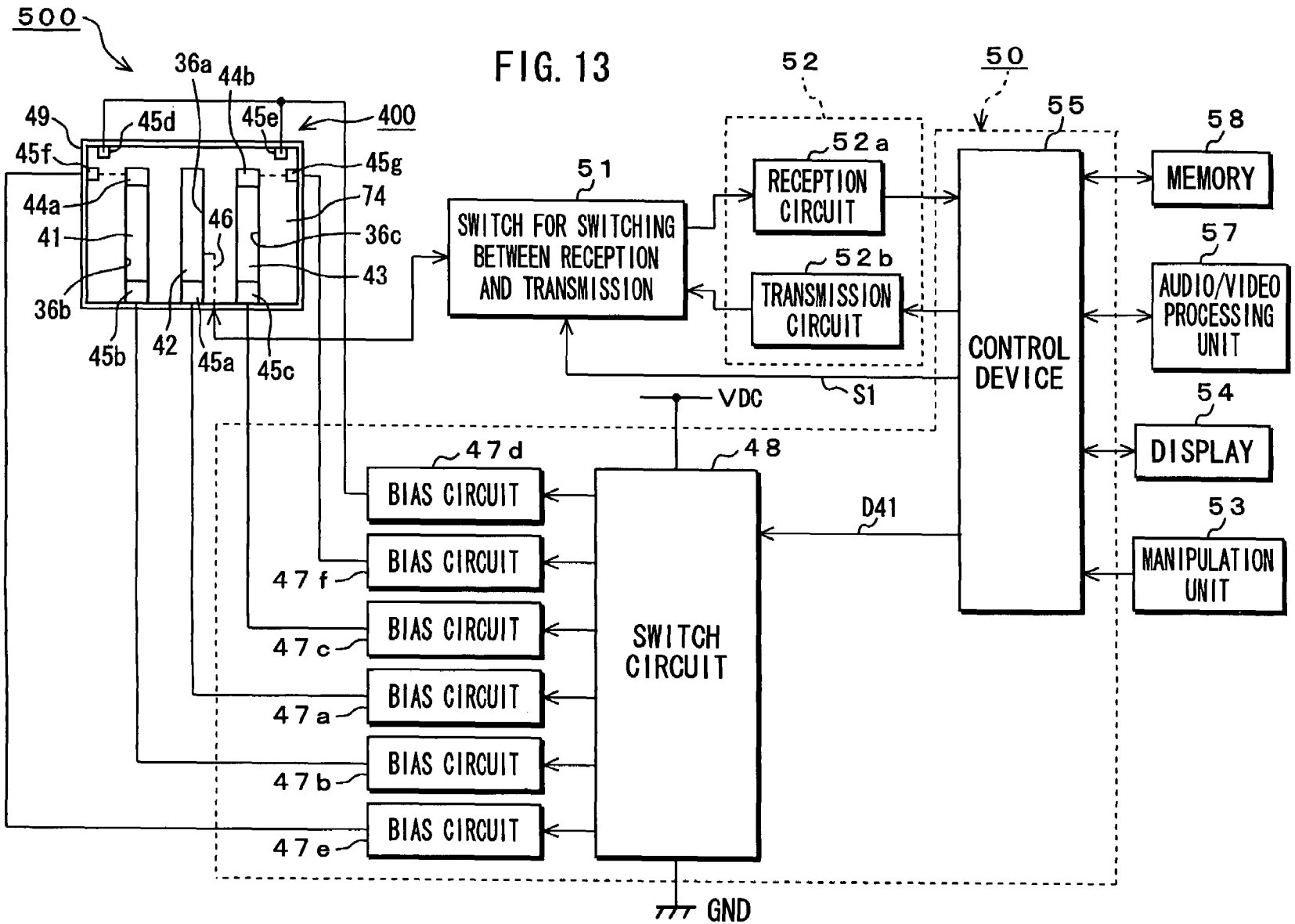
FIG. 13 is a diagram for illustrating a configuration of a wireless communication apparatus, according to a fifth embodiment of the invention, to which the antenna device shown in FIG. 12 is applied.

FIG. 13 illustrates a configuration of a wireless communication apparatus 500, according to a fifth embodiment of the invention, to which the antenna device 400 shown in FIG. 12 is applied.

In the embodiment, the wireless communication apparatus 500 uses the antenna device 400 that has been described in the fourth embodiment. The semi-conductive base plate 74 is provided on the dielectric substrate 49. The base plate 74 made of semi-conductive plastic material has two parasitic antenna slots 36*b*, 36*c* that respectively expose two parasitic antenna elements 41, 43 made of semi-conductive plastic material and the length-adjustment elements 44*a*, 44*b* made of semi-conductive plastic material, and one excited antenna slot 36*a* that exposes the excited antenna element 42 made of semi-conductive plastic material, which is arranged with it being positioned between the two parasitic antenna slots 36*b*, 36*c* with predetermined distances. Forward or reverse biased voltage is applied across each of the control electrodes 45*b*, 45*c* connected with the parasitic antenna element 41, 43 in the parasitic antenna slots 36*b*, 36*c*, the control electrode 45*a* connected with the excited antenna element 42 in the excited antenna slot 36*a*, the control electrodes 45*d*, 45*e* of the base plate 74, and the control electrodes 45*f*, 45*g* of the length-adjustment elements 44*a*, 44*b*. This allows any multi functional diversity scheme that is suitable for a user's environment to be implemented.

The wireless communication apparatus 500 shown in FIG. 13 is preferably based on a wireless communication system for carrier sense multiple access with collision avoidance (CSMA/CA) scheme according to IEEE 802.11 wireless LAN standard. The wireless communication apparatus 500 is preferably applicable to the IEEE 802.11a wireless LAN for home use using carrier frequencies of a 5.2 GHz band, IEEE 802.11b/g wireless LAN for home use using carrier frequencies of a 2.4 GHz band or the like.

The wireless communication apparatus 500 has a communication control unit 50, a switch 51 for switching between reception and transmission, a high-frequency unit 52, a manipulation unit 53, a display 54, an audio/video-processing unit 57, a memory 58, and a multi functional antenna device 400. The wireless communication apparatus 500 implements any multi functional diversity communication. The high-frequency unit 52 constitutes a reception-and-transmission circuit and is connected to the antenna device 400 through the switch 51 for switching between reception and transmission. This enables the high-frequency unit 52 to receive or transmit a signal by the predetermined wireless communication system. For example, the high-frequency unit 52 includes a reception circuit 52*a* and a transmission circuit 52*b*. As the multi functional antenna device 400, the antenna device that has been described in the fourth embodiment of the invention can be used.

The switch 51 is connected to the antenna device 400. The switch 51 switches between the reception circuit 52*a* and the transmission circuit 52*b* in the high-frequency unit 52 so that any one of the reception circuit 52*a* and the transmission circuit 52*b* can be connected to a feeding line 46 of the antenna device 400. The feeding line 46 is connected to the excited antenna element 42 of the antenna device 400 to feed a transmission signal or receive a reception signal.

The reception circuit 52*a* and the transmission circuit 52*b* constitute a reception-and-transmission circuit that receives or transmits a signal according to the multi functional diversity system using the antenna device 400.

The reception circuit 52*a* is connected to the antenna device 400 through the switch 51 and receives the signal from the antenna device 400 through the switch 51 to perform any reception processing.

The transmission circuit 52*b* is connected to the antenna device 400 through the switch 51 and performs any transmission processing on a signal to feed the processed transmission signal to the antenna device 400 through the switch 51.

The communication control unit 50 is connected to the high-frequency unit 52. The communication control unit 50 controls the antenna device 400 based on a signal received from the high-frequency unit 52.

For example, the communication control unit 50 has six bias circuits 47*a* through 47*f*, a switch circuit 48, and a control device 55. The control device 55 performs on-off controls on the switches SW1 through SW6 in the switch circuit 48, shown in FIG. 12, based on any quality of a signal received from the reception circuit 52*a*.

The switch circuit 48 is connected to the antenna device 400 through the six bias circuits 47*a* through 47*f*. The switch circuit 48 is also connected to the control device 55. The control device 55 includes a central processing unit (CPU), a micro processing unit (MPU), A/D converter, D/A converter, modulation/demodulation (Base Band) circuit, media access control (MAC) circuit, and the like, which are not shown.

To the control device 55, the manipulation unit 53, the display 54, the audio/video-processing unit 57, and the memory 58 are connected. The manipulation unit 53 allows a user to manipulate it in order to enter any information on operations of the wireless communication apparatus. The manipulation unit 53 transmits to the control device 55 such the information on the operations of the wireless communication apparatus. AS the manipulation unit 53, a keyboard and a jog dial can be used. The display displays any display information on processing of audio information and video information based on display data. The display 54 is constituted of a liquid crystal display panel. The audio/video-processing unit 57, if receiving a signal, receives the signal from any other nodes and processes it to obtain audio information and video information as well as transmits pieces of the information to the control device 55. The audio/video-processing unit 57, if transmitting a signal, processes the audio information and the video information to produce a signal to be transmitted to a destined node.

To the control device 55, the memory 58 as an example of the storage medium is connected. As the memory 58, a read-only memory (ROM), a random-access memory (RAM) that can write or read information at any time, an electrically erasable programmable ROM (EEPROM) that can electrically erase or write information and/or a hard disk drive (HDD) are used. The memory 58 stores a control program for wireless communication apparatus that receives and transmits a signal according to the multi functional diversity system.

The control program is a computer-readable program. This program can include the steps of: setting the direct-current biased voltages applied across the control electrodes 45*a* through 45*g* in the antenna device 400, which has been described in the fourth embodiment; performing a carrier sense by an omnidirectional antenna formed on the basis of the direct-current biased voltages thus set that is applied across the control electrodes 45*a* through 45*g* in the antenna device 400; setting any feedback of direct-current biased voltages to be applied across the control electrodes 45*a* through 45*g* in the antenna device 400 based on the carrier sense and wireless communication conditions to a wireless communication apparatus of a destined node; adaptively switching directivity/omnidirectivity, radiated polarization and beam-radiating direction of the antenna device formed by the direct-current biased voltages thus fed back that are applied across the control electrodes 45*a* through 45*g* in the antenna device 400.

Thus, using the control program stored in the memory 58 enables wireless communication situation of the antenna device to be selected as optimal one among six types of antennas formed by combinations of the excited antenna element 42, the parasitic antenna elements 41, 43, and the length-adjustment elements 44*a*, 44*b*. Further, using the antenna device set as optimal one allows a horizontally or vertically polarized signal to be received or transmitted.

The control device 55 controls the antenna device 400 via the bias circuits 47*a* through 47*f* and the switch circuit 48. For example, the control device 55 transmits a switch selection signal S1 to the switch 51 to switch between the reception and the transmission of the antenna device 400.

The reception circuit 52*a* measures reception sensitivity (received signal strength indicator (RSSI)). In a case of IEEE802.11a scheme, the reception sensitivity is given by monitoring an automatic gain control (AGC) signal before a quadrature amplitude demodulation has been carried out. Of course, the reception sensitivity can be given by any other methods, in addition to this, such as detection of the decoded data.

The switch circuit 48 receives switch control data D41 from the control device 55 and controls the bias circuits 47*a* through 47*f* to generate any forward or reverse direct-current biased voltages based on the switch control data D41. In this embodiment, according to the antenna device 400, the parasitic antenna elements 41, 43, the excited antenna element 42, the base plate 74, and the length-adjustment elements 44*a*, 44*b*, which are made of the semi-conductive plastic material, are provided and patterned. The switch circuit 48 for switching the switches SW1 through SW6 and six bias circuits 47*a* through 47*f* are also provided. It is thus possible to achieve N species of radiation conditions by this antenna device 400 by controlling the switch setting according to any combinations of the switches SW1 through SW6 as shown in the following TABLE 3.

TABLE 3

| | SETTING | | | | | | |
|---|---|---|---|---|---|---|---|
| | COMBINATION I | | | | | | |
| SWITCHES | 1 | 2 | 3 | 4 | 5 | 6 | REMARKS |
| SW1 | OFF | OFF | OFF | ON | ON | ON | N = 6 |
| SW2 | ON | OFF | OFF | OFF | ON | ON | |
| SW3 | ON | OFF | OFF | OFF | ON | ON | |
| SW4 | ON | ON | ON | OFF | OFF | OFF | |
| SW5 | ON | ON | OFF | OFF | OFF | ON | |
| SW6 | ON | OFF | ON | OFF | ON | OFF | |
| | ↓ | ↓ | ↓ | ↓ | ↓ | ↓ | |
| ANTENNA TYPES | SLOT ANTENNA | YAGI ANTENNA OF SLOT TYPE | | ZEPPELIN ANTENNA | YAGI ANTENNA OF ZEPPELIN TYPE | | |
| DIRECTIVITY | OMNI-DIRECTIONAL | DIRECTIONAL | DIRECTIONAL | OMNI-DIRECTIONAL | DIRECTIONAL | DIRECTIONAL | |
| POLARIZATION | HORIZONTAL POLARIZATION | HORIZONTAL POLARIZATION | HORIZONTAL POLARIZATION | VERTICAL POLARIZATION | VERTICAL POLARIZATION | VERTICAL POLARIZATION | |
| RADIATION | | RADIATION DIRECTION 1 | RADIATION DIRECTION 2 | | RADIATION DIRECTION 1 | RADIATION DIRECTION 2 | |

In TABLE 3, a term, "ON" indicates that any of the switches SW1 through SW6 selects their contact point 48*a*; and a term, "OFF" indicates that any of the switches SW1 through SW6 selects their contact point 48*b*.

According to the TABLE 3, if a combination 1 is set relative to the switches SW1 through SW6 in the antenna device 400, this 10 antenna device forms a slot antenna and has an omnidirectivity and a horizontal polarization. If a combination 2 of the switches is set, this antenna device forms a Yagi antenna of slot type and has directivity, a horizontal polarization and a radiation direction 1 as shown in FIG. 12. If a combination 3 of the switches is set, this antenna device forms a Yagi antenna of slot type and has directivity, a horizontal polarization and a radiation direction 2 as shown in FIG. 12.

If a combination 4 of the switches is set, this antenna device forms a Zeppelin antenna and has an omnidirectivity and a vertical polarization. If a combination 5 of the switches is set, this antenna device forms a Yagi antenna of Zeppelin type and has directivity, a vertical polarization, and a radiation direction 1 shown in FIG. 12. If a combination 6 of the switches is set, this antenna device forms a Yagi antenna of Zeppelin type and has directivity, a vertical polarization, and a radiation direction 2 shown in FIG. 12.

The following will describe a control method of controlling the wireless communication apparatus according to the fifth embodiment of the invention.

Figure 14:
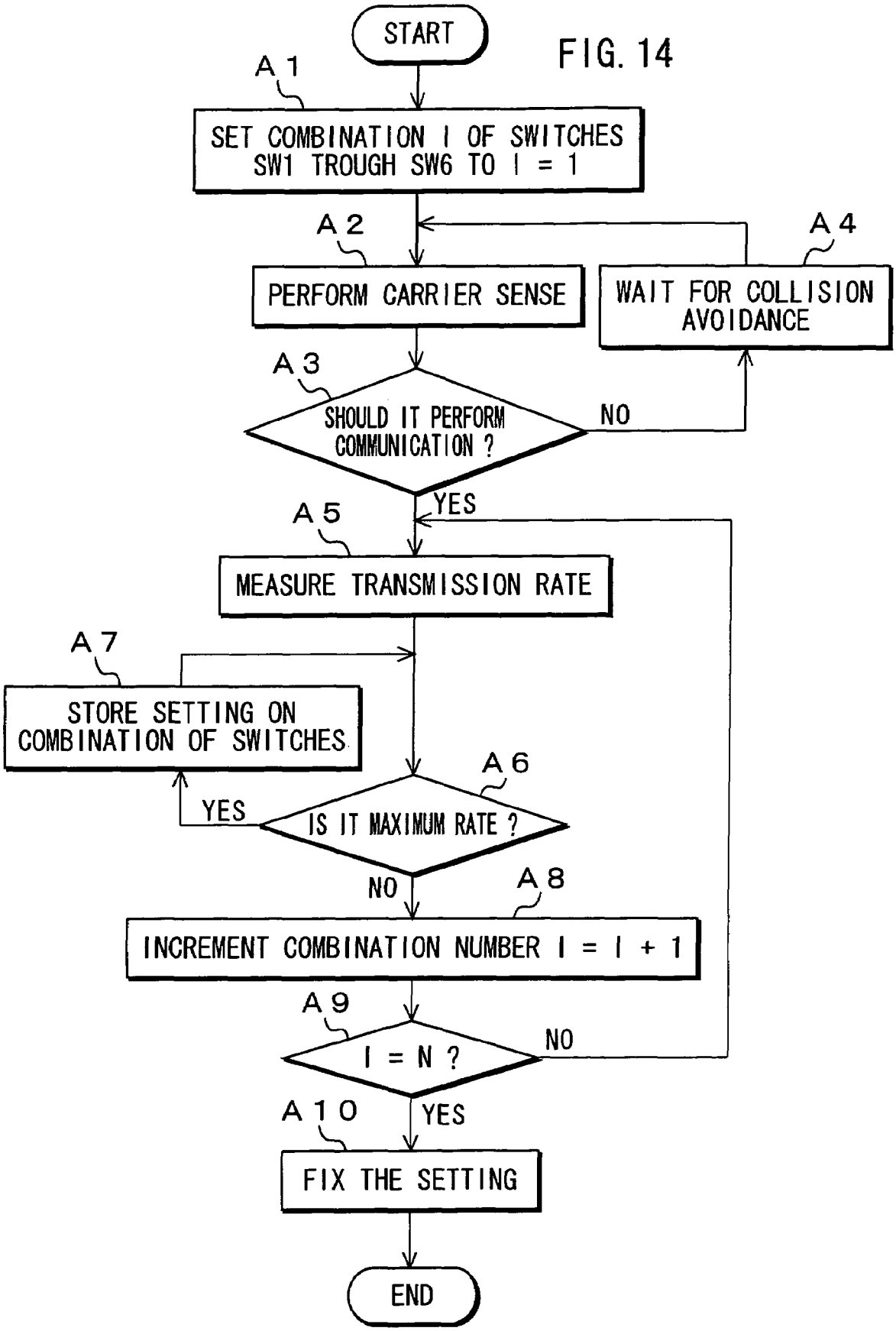
FIG. 14 is a flowchart for showing an operation example of the wireless communication apparatus shown in FIG. 13.

FIG. 14 is a flowchart for showing the control method of controlling the wireless communication apparatus 500 to which the antenna device 400 is applied.

In this embodiment, it is estimated that a multi functional diversity is adopted in this embodiment; after performing a carrier sense and confirming that any other wireless communication apparatus than the transmitting wireless communication apparatus does not stay within a network, the transmitting wireless communication apparatus can communicate with a destined node; and combinations I of the switches are changed so that a communication performance between them can become optimum. In this embodiment, a setting where its transmission rate is maximum is found out with the combinations I of on/off of the six switches SW1 through SW6 changing for N (N=1 to N) species of combinations. The transmitting wireless communication apparatus then can receive and/or transmit a signal from/to the destined node.

Thus, suppose that such the operation setting is given, at step A1 of the flowchart shown in FIG. 14, the combination I of on/off of the six switches SW1 through SW6 is set as I=1. In this moment, the control device 55 controls the antenna device 400 via the bias circuits 47*a* through 47*f* and the switch circuit 48. For example, the control device 55 transmits the switch selection signal Si to the switch 51 to switch between the reception and the transmission of the antenna device 400. Further, the control device 55 transmits to the switch circuit 48 switch selection data D41 for setting the combination I of the switches as I=1.

The process then goes to step A2 where a carrier sense is performed by using the antenna device 400, which indicates an antenna of slot type, omnidirectivity, and a horizontal polarization, formed of the combination 1 of the switches SW1 through SW6. For example, only the switch SW1 as shown in FIG. 12 switches off and the switches SW2 through SW6 respectively switch on. In this moment, the parasitic antenna elements 41, 43, the length-adjustment elements 44*a*, 44*b*, and the base plate 74 are made conductive but the excited antenna element 42 is made insulated. This equals to form a slot in the base plate 74 so that the excited antenna slot 36*a* can act as the excited antenna element. In other words, this forms a slot antenna. This antenna has an omnidirectivity and a horizontal polarization. Using such the omnidirectional antenna enables a carrier sense to be performed. By this carrier sense, it is possible to confirm that a node to which a user wants to transmit a frame is communicating at the present time. Further, it is possible to confirm that any other wireless communication apparatus than the user does not stay within a network.

At step A3, it is determined whether the communication should be performed. If no communication should be performed, namely, in a case where the destined node is communicating, the process goes to step A4 where the user waits for collision avoidance until the destined node finishes communicating. If the destined node finishes communicating, any nodes that want to transmit a frame start to transmit the frame. In this moment, every node has a transmission right equally (multiple access). If the communication should be performed at the step A3, the process goes to step A5 where transmission rate of the data received by the antenna device 400 that has been formed by the combination 1 of the switches is measured. For example, RSSI of the reception circuit 52*a* is measured.

The process then goes to step A6 where it is determined (detected) whether or not the transmission rate is maximum.

If it is determined (detected) that the transmission rate is maximum, the process goes to step A7 where setting on the combination of switches SW1 through SW6 is stored. The process then goes back to the step A6 where it is determined (detected) whether the transmission rate is maximum. If the transmission rate is not maximum at the step A6, the process goes to step A8 where the combination number of the on/off of the six switches SW1 through SW6 is incremented by one (I=I+1) and the process goes to step A9. At the step A9, it is determined whether N (six in this embodiment) species of combinations of the switches SW1 through SW6 have been completed. If N species of combinations have not yet been completed, namely, I<N, the process goes back to the step A5 where transmission rate of the data received by the antenna device 400 that has been formed by the combination 2 of the switches SW1 through SW6 is measured.

When setting the combination 2 of the switches, the switches SW1 through SW3 and SW6 switch off and the switches SW4, SW5 switches on. In this moment, the length-adjustment element 44*a* and the base plate 74 are made conductive but the parasitic antenna elements 41, 43, the length-adjustment element 44*b*, and the excited antenna element 42 are respectively made insulated. This equals to form a slot for a waveguide, an excited antenna slot, and a slot for reflector in the base plate 74. In other words, this forms a Yagi antenna of slot type. This antenna has directivity, a horizontal polarization and a radiation direction 1 as shown in FIG. 12. Using this directional antenna allows direct-current biased voltage that is applied across the control electrodes 45*b*, 45*c* to be fed back and set based on any wireless communication conditions to a wireless communication apparatus of a destined node.

Then, the process such as determination, storage, and increment, in steps A6 through A8 are repeated.

In this embodiment, the transmission rate of the data received by the antenna device 400 (indicating a Yagi antenna device of slot type, a directivity, a horizontal polarization, and a radiation direction 2 shown in FIG. 12) that has been formed by the combination 3 of the switches SW1 through SW6 is measured.

Then, the transmission rate of the data received by the antenna device 400 (indicating a Zeppelin antenna device, an omnidirectivity, and a vertical polarization) that has been formed by the combination 4 of the switches SW1 through SW6 is measured.

Further, the transmission rate of the data received by the antenna device 400 (indicating a Yagi antenna device of Zeppelin type, a directivity, a vertical polarization, and a radiation direction 1 shown in FIG. 12) that has been formed by the combination 5 of the switches SW1 through SW6 is measured.

Additionally, the transmission rate of the data received by the antenna device 400 (indicating a Yagi antenna device of Zeppelin type, a directivity, a vertical polarization, and a radiation direction 2 shown in FIG. 12) that has been formed by the combination 6 of the switches SW1 through SW6 is measured.

If at the step A9, N species of combinations of the switches SW1 through SW6 have been completed (I=N (six in this embodiment)), the process goes to step A10 where the setting is fixed. This enables any communication to be implemented under the setting of the combinations of the switches SW1 through SW6, optimal qualities of which have been detected. Using the polarization used in this case allows to be implemented any wireless communication process by a multi functional diversity system that is preferably suitable for user's environment.

Thus, to the wireless communication apparatus and the control method of controlling the wireless communication apparatus according to the fifth embodiment of the invention, the antenna device 400 according to the embodiment of the invention is applied. Under this condition, if the switch circuit 48 shown in FIG. 13 sets the combination I of the switches as I=1 in a wireless communication system based on CSMA/CA according to IEEE802.11 wireless LAN standard, the antenna device 400 forms a slot antenna and has an omnidirectivity and a horizontal polarization. Using such the omnidirectional antenna enables a carrier sense to be performed.

If the switch circuit 48 sets the combination I of the switches as I=2, the antenna device 400 forms a Yagi antenna of slot type and has a directivity, a horizontal polarization and a radiation direction 1 as shown in FIG. 12. Using this directional antenna allows direct-current biased voltage that is applied across the control electrodes 45*b*, 45*c* to be fed back and set based on any wireless communication conditions to a wireless communication apparatus of a destined node.

Thus, according to the wireless communication apparatus and the control method of controlling the wireless communication apparatus according to the fifth embodiment of the invention, it is possible to adjust the directivity/omnidirectivity, the radiated polarization, and the radiation direction of the antenna device 400 to desired ones without making the antenna device 400 and a wireless communication apparatus 500 large-scaled and/or expensive. This enables a communication performance on reception and transmission of the antenna device 400 and the wireless communication apparatus 500 to a wireless communication apparatus of a destined node or each of the destined nodes to be kept optimal one.

Thus, it is possible to switch the directivity/omnidirectivity, the radiated polarization, and the radiation direction of the antenna device 400 adaptively matching any user's used radio wave environment. This allows the wireless communication apparatus 500 to perform any wireless communication efficiently based on CSMA/CA or the like, thereby improving any communication performance.

Figure 15:
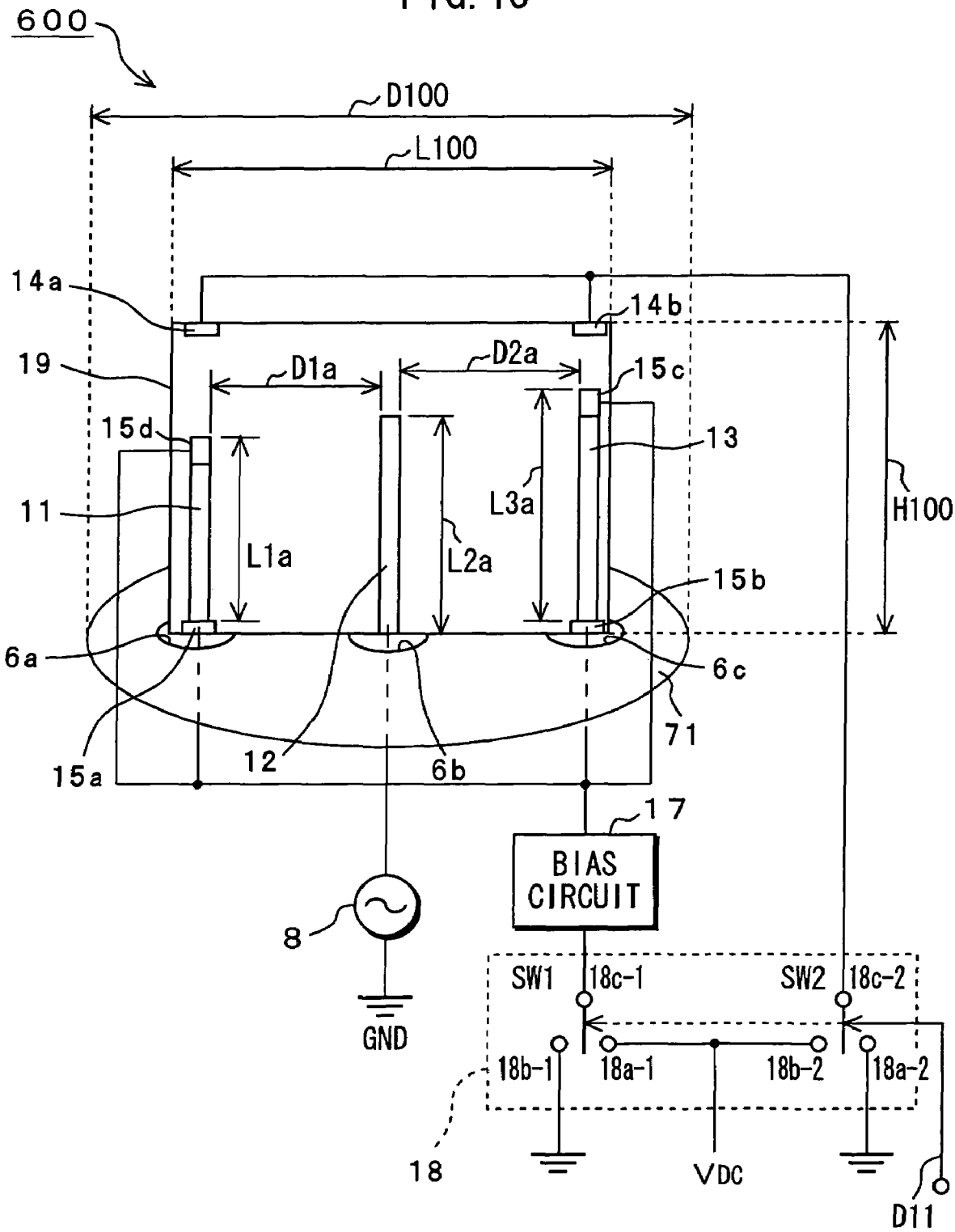
FIG. 15 is a diagram for illustrating a configuration of a Yagi antenna device of monopole type according to a sixth embodiment of the invention.

FIG. 15 illustrates a configuration of a Yagi antenna device 600 of monopole type according to a sixth embodiment of the invention.

The Yagi antenna device 600 shown in FIG. 15 is a variation of the Yagi antenna device 100 according to the first embodiment of the invention. The Yagi antenna device 600 is different from the Yagi antenna device 100 in that the parasitic antenna element 11 is provided with a control electrode 15*d* that is connected to the bias circuit 17 together with the control electrode 15*a*; and the parasitic antenna element 13 is provided with a control electrode 15*c* that is connected to the bias circuit 17 together with the control electrode 15*b*. Like reference characters refer to like elements of the first embodiment, detailed explanation of which will be omitted.

Thus, according to the Yagi antenna device 600 according to the sixth embodiment of the invention, the parasitic antenna element 11 has the control electrodes 15*a*, 15*d* on its top and bottom portion and the parasitic antenna element 13 has the control electrodes 15*b*, 15*c* on its top and bottom portion. This enables direct-current biased voltage to be equally applied across each of the parasitic antenna elements 11, 13 made of semi-conductive plastic material by the bias circuit 17 through the control electrodes 15*a* through 15*d*. It is thus possible to set conductivity and insulation of the antenna device with high fidelity, thereby improving fidelity of the Yagi antenna device 600 as compared with the Yagi antenna device 100 according to the first embodiment.

Figure 16:
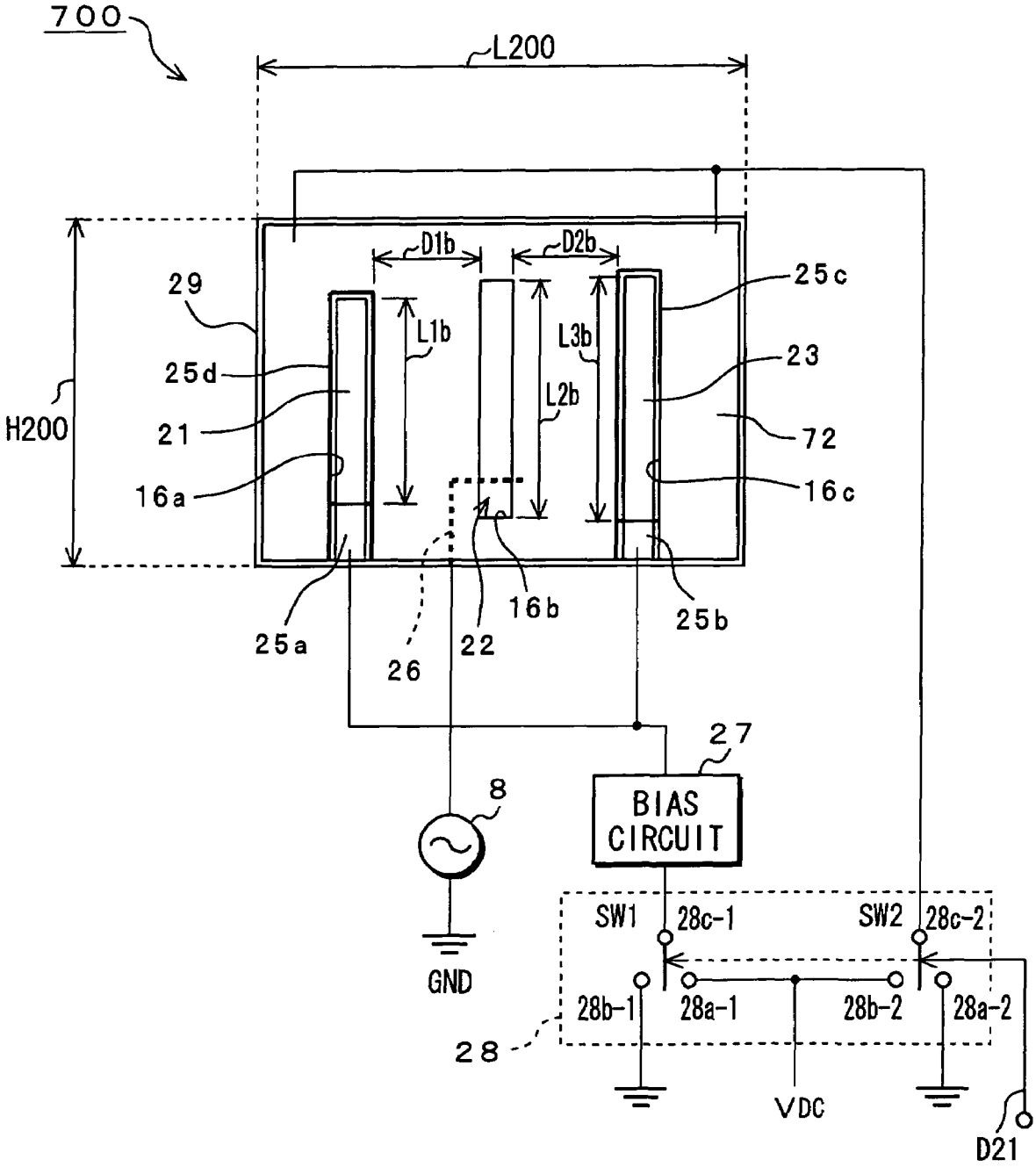
FIG. 16 is a diagram for illustrating a configuration of a Yagi antenna device of slot type according to a seventh embodiment of the invention.

FIG. 16 illustrates a configuration of a Yagi antenna device 700 of slot type according to a seventh embodiment of the invention.

The Yagi antenna device 700 shown in FIG. 16 is a variation of the Yagi antenna device 200 according to the second embodiment of the invention. The Yagi antenna device 700 is different from the Yagi antenna device 200 in that a control electrode 25*d*, which is connected to the bias circuit 27 together with the control electrode 25*a*, is positioned along a periphery of the parasitic antenna slot 16*a*; and a control electrode 25*c*, which is connected to the bias circuit 27 together with the control electrode 25*b*, is positioned along a periphery of the parasitic antenna slot 16*c*. Like reference characters refer to like elements of the second embodiment, detailed explanation of which will be omitted.

Thus, according to the Yagi antenna device 700 according to the seventh embodiment of the invention, the control electrode 25*d*, which is connected to the control electrode 25*a*, is positioned along a periphery of the parasitic antenna slot 16*a* and a control electrode 25*c*, which is connected to the control electrode 25*b*, is positioned along a periphery of the parasitic antenna slot 16*c*. This enables direct-current biased voltage to be equally applied across each of the parasitic antenna elements 21, 23 made of semi-conductive plastic material by the bias circuit 27 through the control electrodes 25*a* through 25*d*. It is thus possible to set conductivity and insulation of the antenna device with high fidelity, thereby improving fidelity of the Yagi antenna device 700 as compared with the Yagi antenna device 200 according to the second embodiment.

Figure 17:
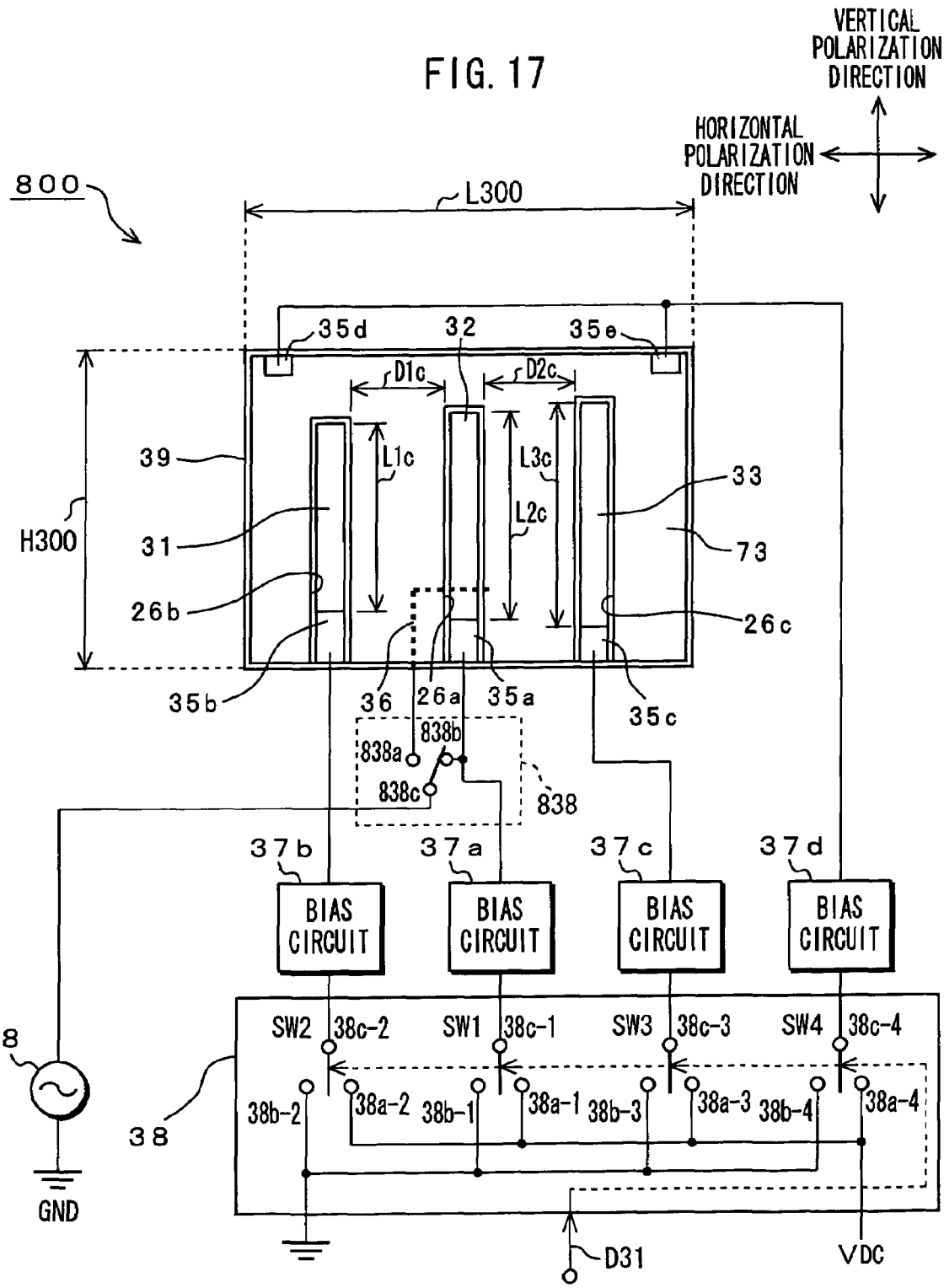
FIG. 17 is a diagram for illustrating a configuration of an antenna device with a polarization switch function according to a eighth embodiment of the invention.

FIG. 17 illustrates a configuration of an antenna device 800 with a polarization switch function according to an eighth embodiment of the invention.

The antenna device 800 shown in FIG. 17 is a variation of the antenna device 300 according to the third embodiment of the invention. The antenna device 800 is different from the antenna device 300 in that the antenna device 800 is provided with a switch 838 for switching feeding. The switch 838 has contact points 838*a*, 838*b*, and a middle fixed point 838*c*.

The contact point 838*a* is connected to the excited antenna slot 26*a* via the feeding line 36. The contact point 838*b* is connected to the control electrode 35*a* and the bias circuit 37*a*. The middle fixed point 838*c* is connected to the signal source 8 via a wired line.

In this embodiment, if the switch 838 selects its contact point 838*a*, its middle fixed point 838*c* is connected to this contact point 838*a* so that a transmission signal can be fed to the excited antenna slot 26*a* from the signal source 8 via the feeding line 36, which is similar to the third embodiment. If the switch 838 selects its contact point 838*b*, its middle fixed point 838*c* is connected to this contact point 838*b* so that the transmission signal can be fed directly to the control electrode 35*a*. Like reference characters refer to like elements of the third embodiment, detailed explanation of which will be omitted.

Thus, according to the antenna device 800 according to the eighth embodiment of the invention, the switch 838 is connected to the signal source 8 and the bias circuit 37*a* and switches a feeding point.

If the transmission signal is fed directly to the control electrode 35*a*, it is easily possible to match the impedance matching as compared with a case where the transmission signal is fed to the excited antenna slot 26*a* via the feeding line 36 (in other words, capacity coupling type feeding). This allows the transmission signal and the like to be fed from the signal source 8 with high fidelity, thereby improving fidelity of the antenna device 800 as compared with the antenna device 300 according to the third embodiment.

Figure 18:
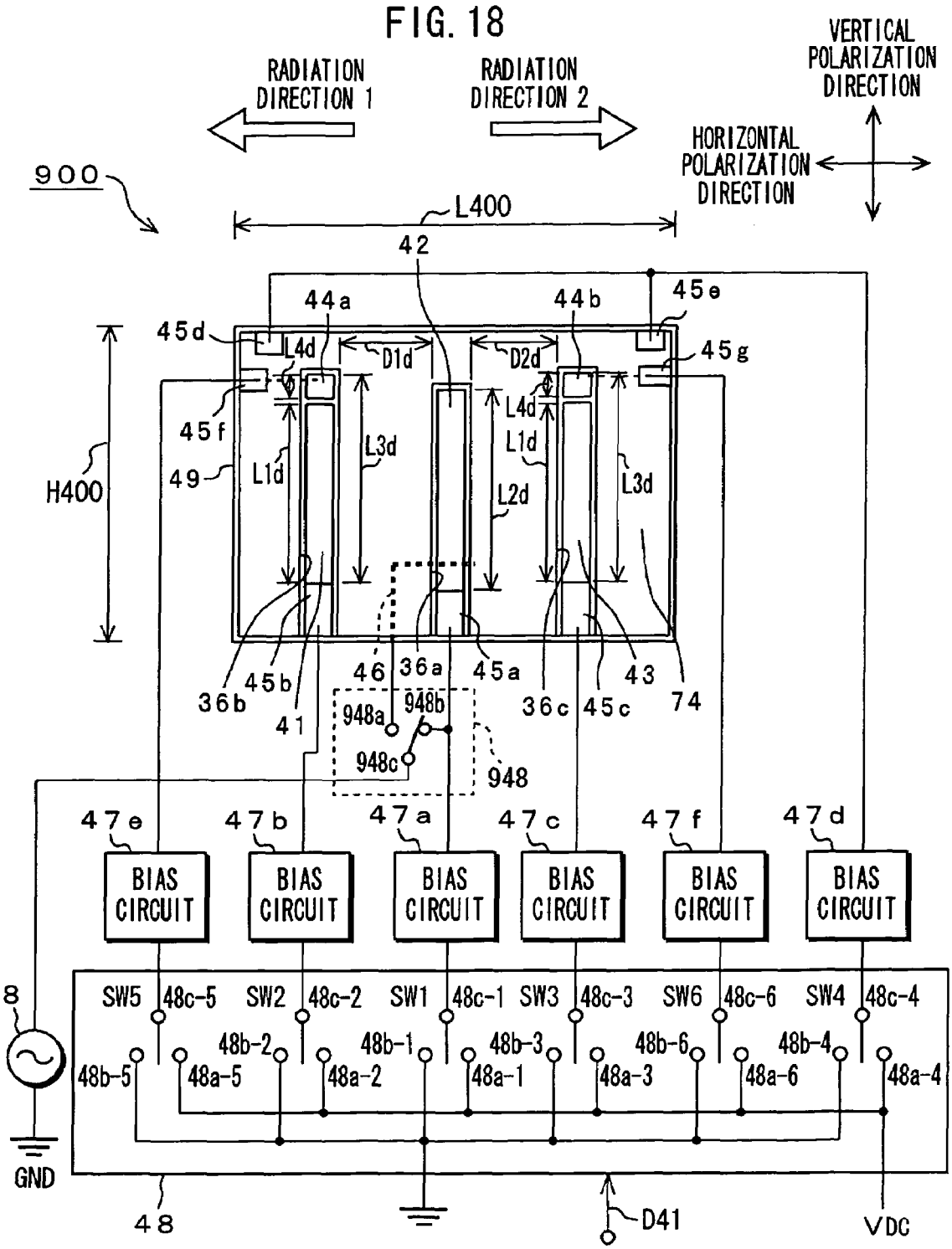
FIG. 18 is a diagram for illustrating a configuration of an antenna device with a radiating direction selection function according to a ninth embodiment of the invention.

FIG. 18 illustrates a configuration of an antenna device 900 with a radiating direction selection function according to a ninth embodiment of the invention.

The antenna device 900 shown in FIG. 18 is a variation of the antenna device 400 according to the fourth embodiment of the invention. The antenna device 900 is different from the antenna device 400 in that the antenna device 900 is provided with a switch 948 for switching feeding. The switch 948 has contact points 948*a*, 948*b*, and a middle fixed point 948*c*.

The contact point 948*a* is connected to the excited antenna slot 36*a* via the feeding line 46. The contact point 948*b* is connected to the control electrode 45*a* and the bias circuit 47*a*. The middle fixed point 948*c* is connected to the signal source 8 via a wired line.

In this embodiment, if the switch 948 selects its contact point 948*a*, its middle fixed point 948*c* is connected to this contact point 948*a* so that a transmission signal can be fed to the excited antenna slot 36*a* from the signal source 8 via the feeding line 46, which is similar to the fourth embodiment. If the switch 948 selects its contact point 948*b*, its middle fixed point 948*c* is connected to this contact point 948*b* so that the transmission signal can be fed directly to the control electrode 45*a*. Like reference characters refer to like elements of the fourth embodiment, detailed explanation of which will be omitted.

Thus, according to the antenna device 900 according to the ninth embodiment of the invention, the switch 948 is connected to the signal source 8 and the bias circuit 47*a* and switches a feeding point.

If the transmission signal is fed directly to the control electrode 45*a*, it is easily possible to match the impedance matching as compared with a case where the transmission signal is fed to the excited antenna slot 36*a* via the feeding line 46 (in other words, capacity coupling type feeding). This allows the transmission signal and the like to be fed from the signal source 8 with high fidelity, thereby improving fidelity of the antenna device 900 as compared with the antenna device 400 according to the fourth embodiment.

Although, in the above embodiments, the transmission rate of data has been measured as the wireless communication condition, this invention is not limited thereto. For example, any other wireless communication condition such as a throughput, an error rate (bit error rate (BER), packet error rate (PER)), signal strength (RSSI, Eb/NO) can be measured. It is to be noted that the multi functional diversity scheme as the embodiment according to the invention is applicable to a directional diversity, polarized diversity, and multi input multi output (MIMO) communication system.

Although, in the embodiments, cases where the antenna device 400 described in the fourth embodiment are applied to the wireless communication apparatus have been described, this invention is not limited thereto. For example, the wireless communication apparatus to which any one of the antenna devices 100, 200, 300 as the first, second, and third embodiments and the antenna devices 600, 700, 800, 900 as the sixth, seventh, eighth and ninth embodiments are applied can be configured. Forward or reverse direct-current biased voltage applied across each of the control electrodes in the above antenna devices is controlled so that the communication control unit 50 can control each of the semi-conductive antenna bodies to be switched between their insulation state and their conductive state, thereby adjusting directivity/omnidirectivity, radiated polarization of the antenna device to desired ones.

The embodiments of the invention are preferably applied to an antenna device, a wireless communication apparatus and the like that carries out any wireless communication by means of a directional antenna or an omnidirectional antenna that is formed by controlling the direct-current biased voltage applied across the control electrodes of the antenna bodies made of semi-conductive plastic material, which are positioned on the dielectric substrate.

It should be understood by those skilled in the art that various modifications, combinations, sub-combinations and alternations may occur depending on design requirements and other factors insofar as they are within the scope of the appended claims or the equivalents thereof.

What is claimed is:

1. An antenna device comprising:

semi-conductive antenna bodies each having a predetermined length, said antenna bodies being positioned on a dielectric substrate; and control electrodes that are respectively connected with the semi-conductive antenna bodies, wherein direct-current biased voltage that is applied across each of the control electrodes is controlled to switch each of the semi-conductive antenna bodies between their insulation state and their conductive state.

2. The antenna device according to claim 1 wherein forward biased voltage is applied across each of the control electrodes if making the semi-conductive antenna bodies conductive, thereby allowing ion to be moved from the dielectric substrate to the semi-conductive antenna bodies; and wherein reverse biased voltage is applied across each of the control electrode if making the semi-conductive antenna bodies insulated, thereby allowing ion to be moved from each of the semi-conductive antenna bodies to the dielectric substrate.

3. The antenna device according to claim 1 wherein the semi-conductive antenna bodies are switched between their insulation state and their conductive state to adjust directivity, radiated polarization, and radiation direction of the antenna device to desired ones.

4. The antenna device according to claim 1 wherein each of the semi-conductive antenna bodies has a length corresponding to a wavelength of a frequency within any one of a millimeter wave band, a micrometer wave band, and an ultra-high frequency band.

5. The antenna device according to claim 1 further comprising a conductive antenna body;

wherein the semi-conductive antenna bodies include two line antenna bodies having different lengths, said line antenna bodies being positioned on both sides of the dielectric substrate;

wherein the conductive antenna body is arranged on a middle of the substrate, said conductive antenna body being away from each of the line antenna bodies by a predetermined distance;

wherein the conductive antenna body is fed; and wherein any one of the forward and reverse biased voltages is applied across each of the control electrodes.

6. The antenna device according to claim 1 further comprising a base plate for grounding, wherein the dielectric substrate is positioned on the base plate with them being intersected with each other.

7. The antenna device according to claim 1 further comprising a conductive antenna plate that is positioned on the dielectric substrate, said conductive antenna plate having two slots that expose two semi-conductive antenna bodies, and one slot acting as an excited antenna element, said one slot being arranged with it being positioned between the two slots with a predetermined distance, wherein the one slot is fed; and wherein any one of the forward and reverse biased voltages is applied across each of the control electrodes.

8. The antenna device according to claim 1 further comprising:

a semi-conductive antenna plate that is positioned on the dielectric substrate; and control electrodes that are positioned at the semi-conductive antenna plate, wherein the semi-conductive antenna plate includes three line antenna bodies on the dielectric substrate, the line antenna bodies having different lengths from each other;

wherein the semi-conductive plate has three slots that expose the three semi-conductive antenna bodies, respectively, said slots also acting as antenna bodies;

wherein a middle one of the three slots is fed;

wherein any one of the forward and reverse biased voltages is applied across each of the control electrodes that are connected with the semi-conductive antenna bodies and the control electrodes that are positioned at the semi-conductive antenna plate; and wherein the line antenna bodies and the slots are switched as the antenna bodies based on an application of the forward and reverse biased voltages.

9. The antenna device according to claim 8 wherein the three line antenna bodies are switched between their insulation state and their conductive state to adjust directivity, radiated polarization, and radiation direction of the antenna device to desired ones.

10. The antenna device according to claim 1 further comprising:

a semi-conductive antenna plate that is positioned on the dielectric substrate, the semi-conductive antenna plate including three line antenna bodies on the dielectric substrate, the middle line antenna body having a predetermined length, the side line antenna bodies each having a length-adjusting portion for adjusting each of the side line antenna bodies to two divided lengths;

control electrodes that are positioned at the semi-conductive antenna plate; and control electrodes that are positioned on the length-adjusting portions of the side line antenna bodies;

wherein the semi-conductive antenna plate has three slots that expose the three line antenna bodies, respectively, said slots also acting as antenna bodies;

wherein the middle one of the three slots is fed;

wherein any one of the forward and reverse biased voltages is applied across each of the control electrodes that are connected with the semi-conductive antenna bodies, the control electrodes that are positioned at the semi-conductive antenna plate, and the control electrodes that are positioned on the length-adjusting portions of the side line antenna bodies; and wherein the line antenna bodies and the slots are switched as the antenna bodies based on an application of the forward and reverse biased voltages.

11. The antenna device according to claim 10 wherein the three line antenna bodies are switched between their insulation state and their conductive state to adjust directivity, radiated polarization, and radiation direction of the antenna device to desired ones.

12. The antenna device according to claim 1 wherein the semi-conductive antenna bodies are made of resin material selected from the group consisting of polyacetylene, polythiophene, polyaniline, polypyrrol, and polyazulene.

13. The antenna device according to claim 1 wherein the dielectric substrate is made of solid electrolyte material selected from the group consisting of silicon gel, acrylonitrile gel, and polysaccharide polymer.

14. A wireless communication apparatus comprising:

an antenna device;

a reception-and-transmission circuit that transmits and receives a signal according to a predetermined communication system, said reception-and-transmission circuits being connected to the antenna device; and a communication control unit that controls the antenna device based on a signal received from the reception-and-transmission circuit, wherein the antenna device including:

semi-conductive antenna bodies each having a predetermined length, said antenna bodies being positioned on a dielectric substrate; and control electrodes that are respectively connected with the semi-conductive antenna bodies, wherein the communication control unit controls direct-current biased voltage applied across each of the control electrodes to switch each of the semi-conductive antenna bodies between their insulation state and their conductive state.

15. The wireless communication apparatus according to claim 14 wherein the predetermined communication system includes carrier sense multiple access with collision avoidance (CSMA/CA) according to IEEE802.11 wireless LAN standard.

16. The wireless communication apparatus according to claim 14 wherein forward biased voltage is applied across each of the control electrodes if making the semi-conductive antenna bodies conductive, thereby allowing ion to be moved from the dielectric substrate to the semi-conductive antenna bodies; and wherein reverse biased voltage is applied across each of the control electrode if making the semi-conductive antenna bodies insulated, thereby allowing ion to be moved from each of the semi-conductive antenna bodies to the dielectric substrate.

17. The wireless communication apparatus according to claim 14 wherein the semi-conductive antenna bodies are switched between their insulation state and their conductive state to adjust directivity, radiated polarization, and radiation direction of the antenna device to desired ones.

18. The wireless communication apparatus according to claim 14 wherein the antenna device further comprises a conductive antenna body;

wherein the semi-conductive antenna bodies include two line antenna bodies having different lengths, said line antenna bodies being positioned on both sides of the dielectric substrate;

wherein the conductive antenna body is arranged on a middle of the substrate, said conductive antenna body being away from each of the line antenna bodies by a predetermined distance;

wherein the conductive antenna body is fed; and wherein any one of the forward and reverse biased voltages is applied across each of the control electrodes.

19. The wireless communication apparatus according to claim 14 wherein the antenna device further comprises a base plate for grounding, and wherein the dielectric substrate is positioned on the base plate with them being intersected with each other.

20. The wireless communication apparatus according to claim 14 wherein the antenna device further comprises a conductive antenna plate that is positioned on the dielectric substrate, said conductive antenna plate having two slots that expose two semi-conductive antenna bodies having different lengths, and one slot acting as an excited antenna element, said one slot being arranged with it being positioned between the two slots with a predetermined distance, wherein the one slot is fed; and wherein any one of the forward and reverse biased voltages is applied across each of the control electrodes.

21. The wireless communication apparatus according to claim 14 wherein the antenna device further comprises:

a semi-conductive antenna plate that is positioned on the dielectric substrate; and control electrodes that are positioned at the semi-conductive antenna plate, wherein the semi-conductive antenna plate includes three line antenna bodies on the dielectric substrate, the line antenna bodies having different lengths from each other;

wherein the semi-conductive plate has three slots that expose the three semi-conductive antenna bodies, respectively, said slots also acting as antenna bodies;

wherein a middle one of the three slots is fed;

wherein any one of the forward and reverse biased voltages is applied across each of the control electrodes that are connected with the semi-conductive antenna bodies and the control electrodes that are positioned at the semi-conductive antenna plate; and wherein the line antenna bodies and the slots are switched as the antenna bodies based on an application of the forward and reverse biased voltages.

22. The wireless communication apparatus according to claim 21 wherein the three line antenna bodies are switched between their insulation state and their conductive state to adjust directivity, radiated polarization, and radiation direction of the antenna device to desired ones.

23. The wireless communication apparatus according to claim 14 wherein the antenna device further comprises:

a semi-conductive antenna plate that is positioned on the dielectric substrate, the semi-conductive antenna plate including three line antenna bodies on the dielectric substrate, the middle line antenna body having a predetermined length, the side line antenna bodies each having a length-adjusting portion for adjusting each of the side line antenna bodies to two divided lengths;

control electrodes that are positioned at the semi-conductive antenna plate; and control electrodes that are positioned on the length-adjusting portions of the side line antenna bodies;

wherein the semi-conductive antenna plate has three slots that expose the three line antenna bodies, respectively, said slots also acting as antenna bodies;

wherein the middle one of the three slots is fed;

wherein any one of the forward and reverse biased voltages is applied across each of the control electrodes that are connected with the semi-conductive antenna bodies, the control electrodes that are positioned at the semi-conductive antenna plate, and the control electrodes that are positioned on the length-adjusting portions of the side line antenna bodies; and wherein the line antenna bodies and the slots are switched as the antenna bodies based on an application of the forward and reverse biased voltages.

24. The wireless communication apparatus according to claim 23 wherein the three line antenna bodies are switched between their insulation state and their conductive state to adjust directivity, radiated polarization, and radiation direction of the antenna device to desired ones.

25. The wireless communication apparatus according to claim 14 wherein the semi-conductive antenna bodies are made of resin material selected from the group consisting of polyacetylene, polythiophene, polyaniline, polypyrrol, and polyazulene.

26. The wireless communication apparatus according to claim 14 wherein the dielectric substrate is made of solid electrolyte material selected from the group consisting of silicon gel, acrylonitrile gel, and polysaccharide polymer.

* * * * *